US009358799B2

(12) United States Patent
Ito et al.

(10) Patent No.: US 9,358,799 B2
(45) Date of Patent: Jun. 7, 2016

(54) FLOW PATH MEMBER, INK JET HEAD, AND INK JET PRINTER

(71) Applicant: Seiko Epson Corporation, Tokyo (JP)

(72) Inventors: Kazunori Ito, Matsumoto (JP); Takeshi Owaku, Shiojiri (JP); Hiroki Miyajima, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/794,979

(22) Filed: Jul. 9, 2015

(65) Prior Publication Data

US 2016/0059576 A1 Mar. 3, 2016

(30) Foreign Application Priority Data

Sep. 1, 2014 (JP) ..... 2014-176909

(51) Int. Cl.
*B41J 2/175* (2006.01)
*B41J 2/19* (2006.01)

(52) U.S. Cl.
CPC ..... *B41J 2/17563* (2013.01); *B41J 2/17523* (2013.01); *B41J 2/19* (2013.01)

(58) Field of Classification Search
None
See application file for complete search history.

(56) References Cited

U.S. PATENT DOCUMENTS

2003/0156173 A1* 8/2003 Yamaguchi et al. ..... 347/87

FOREIGN PATENT DOCUMENTS

JP 2009-101578 A 5/2009
JP 2013-129060 A 7/2013

* cited by examiner

*Primary Examiner* — Shelby Fidler
*Assistant Examiner* — Tracey McMillion
(74) *Attorney, Agent, or Firm* — Harness, Dickey & Pierce, P.L.C.

(57) ABSTRACT

A flow path member includes a first space which is opened by a first liquid flow path, and into which liquid flows from the first liquid flow path; a second space which is opened by a second liquid flow path on a bottom surface at the opposite side to the first space, and out of which liquid flows from the second liquid flow path; a filter which filters liquid passing therethrough, and which is included between the first space and the second space; and a support which protrudes from the bottom surface of the second space toward the filter side, in which the support is a point-form projection.

17 Claims, 20 Drawing Sheets

FLOW PATH MEMBER, INK JET HEAD, AND INK JET PRINTER

BACKGROUND

1. Technical Field

The present invention relates to a flow path member which has a filter that removes foreign matter which is included in liquid, an ink jet head which includes the flow path member, and an ink jet printer.

2. Related Art

The ink jet printer includes a permanent head, and is an apparatus which ejects (discharges) various liquids from the permanent head. The ink jet printer is a non-impact type printing apparatus, in which characters are formed by ejecting particles or droplets of ink onto a paper sheet (JIS X0012-1990). A dot printer that is a printer which prints a character or an image that is expressed at a plurality of points is one aspect, and prints the character or the image which is expressed by the plurality of points that are formed by ejection of particles or droplets of ink. In addition, the permanent head continuously or intermittently generates liquid droplets of ink, and is a machine section or electric section of a printer body (hereinafter referred to as an "ink jet head") (JIS Z8123-1: 2013). In addition to being used as an image recording apparatus, the ink jet printer is also applied to various manufacturing apparatuses by taking advantage of the feature in which it is possible to accurately land a very small amount of liquid at a prescribed position. For example, the ink jet printer is applied to a display manufacturing apparatus which manufactures a color filter of a liquid crystal display or the like, an electrode forming apparatus which forms an electrode such as an organic EL (Electro Luminescence) display, an FED (Field Emission Display) or the like, and a chip manufacturing apparatus which manufactures a bio chip (bio-chemical element). Then, a recording head for the image recording apparatus ejects liquid ink, and a color ejecting head for the display manufacturing apparatus ejects each color liquid of R (red), G (green), and B (blue). In addition, an electrode material ejecting head for the electrode forming apparatus ejects electrode material in liquid form, and a bio-organic material ejecting head for the chip manufacturing apparatus ejects liquid bio-organic material.

The ink jet head above takes in ink from an ink cartridge into which ink that is one type of liquid is filled to a pressure chamber via a liquid flow path within a flow path member, and ejects ink droplets from a nozzle by generating pressure variation in ink within the pressure chamber by driving of a piezoelectric element (one type of actuator). In addition, the flow path member is known which includes a filter at the middle of a liquid flow path in order to remove bubbles, foreign matter, and the like which are included in ink (for example, refer to JP-A-2009-101578).

In such a flow path member which includes a filter, there are times when the filter changes shape at the downstream side due to pressure of flowing ink. In particular, it is easy for the filter to change shape at the downstream side in a case where liquid ink with a relatively high viscosity or the like passes through the filter. Then, when the filter changes shape at the downstream side and comes into contact with a wall surface of the liquid flow path at the downstream side, for example, a bottom surface of a filter chamber on which the filter is arranged or the like, the effective area of the filter is reduced and pressure loss is increased. Thereby, back pressure of the liquid flow path at the downstream side is reduced and there is a risk that a meniscus of ink which is formed in the nozzle is destroyed.

SUMMARY

An advantage of some aspects of the invention is to provide a flow path member which suppresses pressure loss using a filter, an ink jet head which includes the flow path member, and an ink jet printer.

A flow path member of the invention provided in order to realize the above advantage including: a first space which is opened by a first liquid flow path, and into which liquid flows from the first liquid flow path; a second space which is opened by a second liquid flow path on a bottom surface at the opposite side to the first space, and out of which liquid flows from the second liquid flow path; a filter which filters liquid passing therethrough, and which is included between the first space and the second space; and a support which protrudes from the bottom surface of the second space toward the filter side, in which the support is a point-form projection.

According to the invention, even in a case where the filter is pressed to the bottom surface side due to pressure of ink which flows, it is possible to suppress the filter from sticking to the bottom surface. Thereby, it is possible to suppress the effective area (filtering execution area) of the filter being reduced. In addition, it is possible to narrow a gap between the filter and the bottom surface, and it is possible to realize a flow path member with a low height. In addition, since the support is formed in a point form, it is difficult for bubbles which are mixed in the second space to catch on the support. Thereby, it is possible to improve discharge of bubbles.

In the configuration above, it is desirable for an opening position of the second space of the second liquid flow path to be eccentric in the in-plane direction of a surface parallel to the filter with respect to an opening position of the first space of the first liquid flow path.

According to this configuration, degree of design freedom increases since there is no need to arrange an opening of the first liquid flow path and an opening of the second liquid flow path symmetrically opposite. In addition, it is possible to increase the effective area of the filter since it is easy for liquid which flows in from the opening of the first liquid flow path to disperse and pass through the filter in comparison to in a case where the opening of the second liquid flow path and the opening of the first liquid flow path are arranged symmetrically opposite interposing the filter.

In each configuration above, it is desirable to fix a leading end section of the support to the filter.

According to this configuration, it is possible to prevent generation of foreign matter due to the leading end section of the support and the filter rubbing.

In addition, in the configuration above, it is desirable to include a welding portion that has thermoplasticity in the leading end section of the support, and fix the leading end section of the support to the filter by fusing of the welding portion.

According to this configuration, it is possible to easily fix the leading end section of the support to the filter.

Furthermore, in each configuration above, it is desirable for the second space to include a plurality of second liquid flow paths, and the support to be included within a region which is interposed between the opening centers of at least two second liquid flow paths in the long direction of the filter.

According to this configuration, it is possible to reduce the number of components since there is no need to include each of the second space which correspond to the plurality second liquid flow paths, and the filter. In addition, it is possible to reduce the size of the flow path member since there is no need to include a region in which the filter is fixed to each second liquid flow path, a wall section which partitions the second liquid flow paths, or the like. In addition, it is possible to more effectively suppress sticking to the bottom surface due to deflection of the filter since the support is included within a region which is interposed between the opening centers of the second liquid flow paths.

In addition, in the configuration above, it is desirable for the second space to include at least three second liquid flow paths, and the support to be include within a region which is surrounded by the opening centers of at least the plurality of second liquid flow paths.

According to this configuration, it is possible to further effectively suppress sticking to the bottom surface due to deflection of the filter.

Furthermore, in each configuration above, it is desirable for a recessed chamber where the diameter reduces from the filter side of each second liquid flow path toward the opening of the second liquid flow path to be formed on the bottom surface of the second space, and each recessed chamber to be partitioned by a ridge which is raised from the bottom surface toward the filter side between the openings of adjacent second liquid flow paths, and to be linked by a gap between the ridge and the filter.

According to this configuration, it is possible to suppress a reduction of effective area of the filter since the gap is included between the ridge and the filter. In addition, it is possible increase flow speed due to the inclination of the ridge, and it is possible to improve bubble discharge.

In addition, in each configuration above, it is desirable for a plurality of the supports to be included within the region.

According to this configuration, it is possible to further effectively suppress sticking to the bottom surface due to deflection of the filter.

Furthermore, in each configuration above, it is desirable for the filter to be fixed to an opening edge of the second space, the support to be included outside of the region in the second space, and at least the support which is included outside of the region to protrude further to the first space side than the surface of the second space side of the filter in the region in which the filter is fixed.

According to this configuration, it is possible to further effectively suppress sticking to the bottom surface due to deflection of the filter.

Then, the ink jet head of the invention includes the flow path member of each configuration above.

In addition, the ink jet printer of the invention includes the ink jet head of the configuration above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
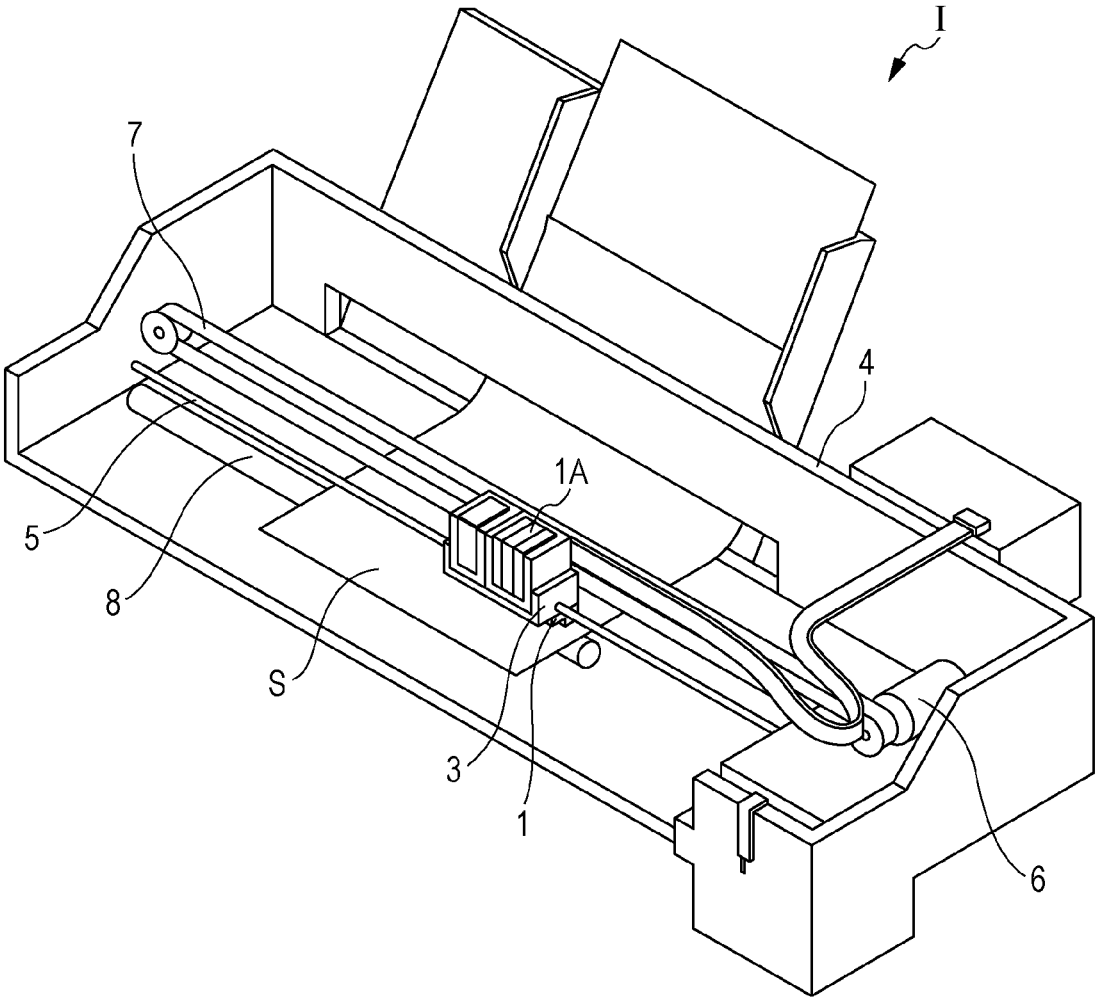
FIG. 1 is perspective diagram of a printer.

Embodiments of the invention will be described below with reference to the drawings. Here, in the embodiments described below, there are various limitations as preferred specific examples of the invention, but the scope of the invention is not limited to these aspects unless particular limitations of the invention are otherwise stated in the explanation below. In addition, an example of an ink jet image recording apparatus (hereinafter, printer I) given as the ink jet printer of the invention is described below.

First, the configuration of the printer I in the present embodiment will be described with reference to the drawings. The printer I is an apparatus which performs recording of an image or the like by ejecting ink in liquid form on the surface of a recording medium S such as recording paper. The printer I includes an ink jet recording head (hereinafter, recording head 1) which is one type of ink jet head, a carriage 3 to which the recording head 1 is attached, and a carriage moving mechanism which moves the carriage 3 in a main scanning direction. In addition, the printer I includes, for example, a platen roller 8 as a mechanism which moves the recording medium S in a sub-scanning direction. A drum or the like may be used as the moving mechanism instead of the platen roller 8. Here, the ink described above is one type of liquid of the invention, and is retained in an ink cartridge 1A which acts as a liquid supply source. The ink cartridge 1A is mounted so as to be attachable and detachable with respect to the recording head 1. Here, it is also possible to adopt a configuration in which the ink cartridge 1A is arranged at a printer main body 4 side, and ink is supplied from the ink cartridge 1A to the recording head 1 through an ink supply tube.

The carriage moving mechanism described above includes a timing belt 7. Then, the timing belt 7 is driven by a pulse motor 6 such as a DC motor. Accordingly, when the pulse motor 6 is operated, the carriage 3 is guided on a guide rod 5 which is installed in the printer main body 4 and moves reciprocally in the main scanning direction.

Figure 2:
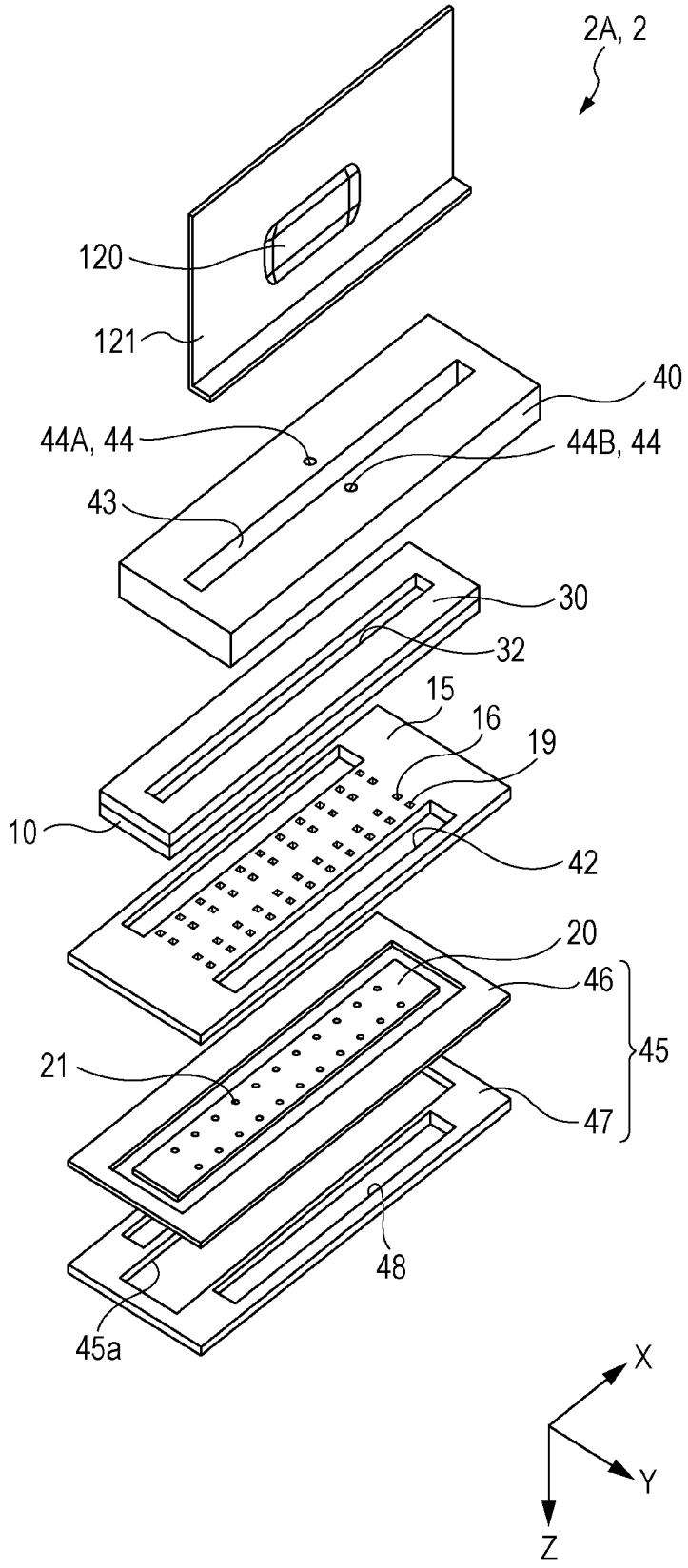
FIG. 2 is an exploded perspective diagram of a first head main body.
Figure 3:
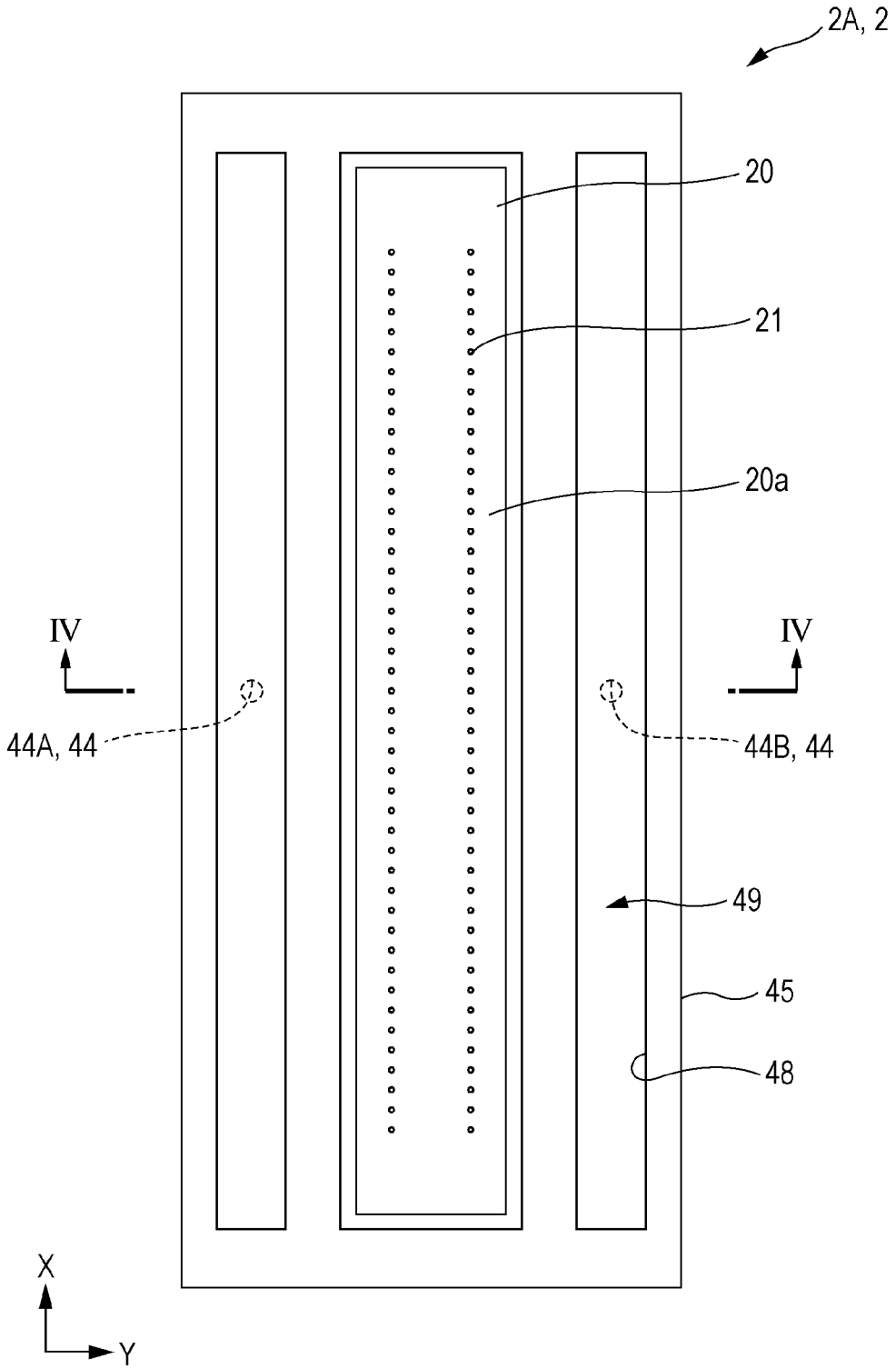
FIG. 3 is a planar diagram of the first head main body.
Figure 4:
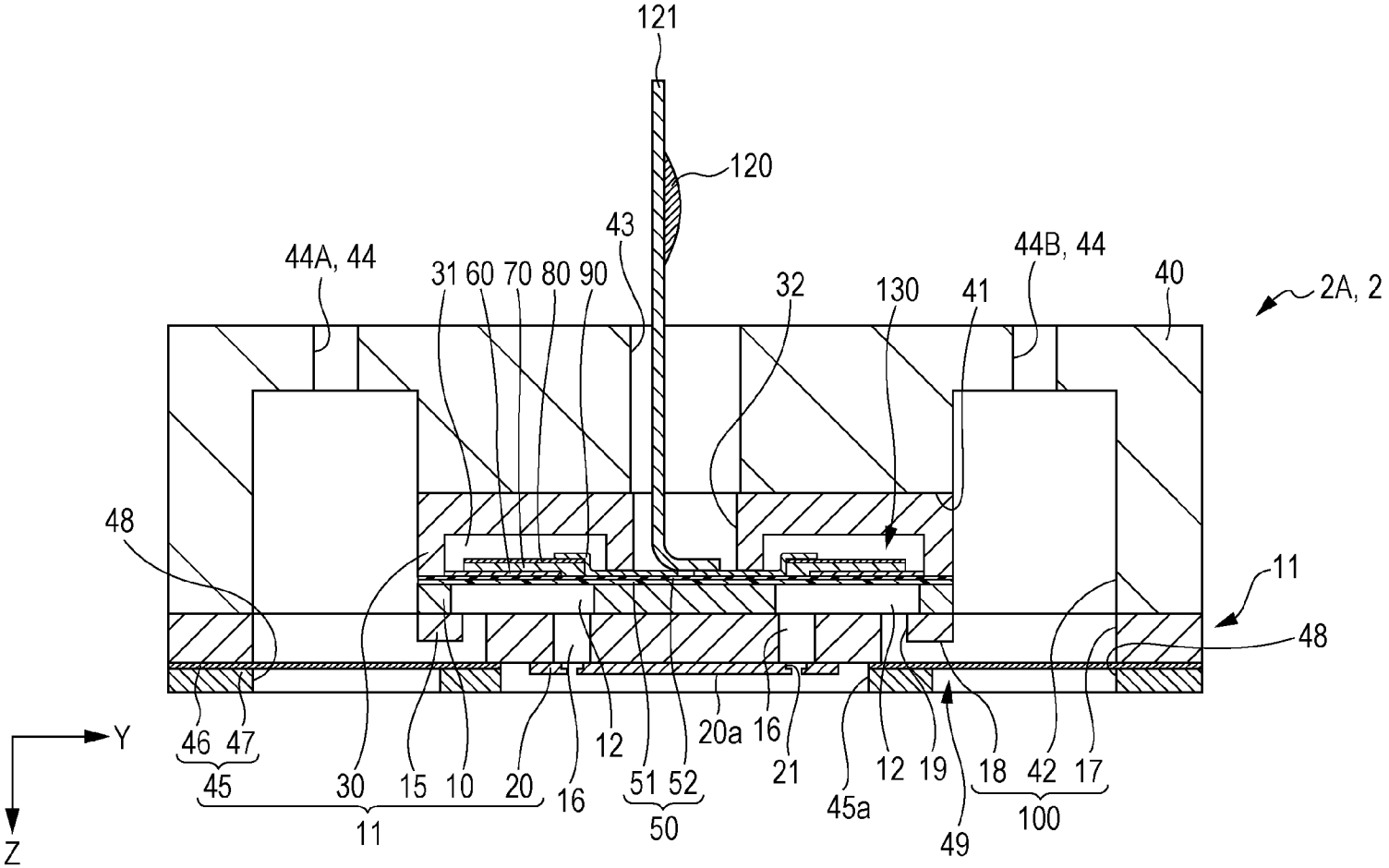
FIG. 4 is a sectional diagram of the first head main body.

Next, a head main body 2 which is included inside the recording head 1 will be described. FIG. 2 is an exploded perspective diagram of a first head main body 2A which is an example of the head main body 2. In addition, FIG. 3 is a planar diagram of the first head main body 2A, and FIG. 4 is a sectional diagram along line IV-IV in FIG. 3. Here, the relationship between each direction (X, Y, and Z) is described in each drawing where the nozzle row direction is the first direction X, the direction in which the nozzle row is lined up in (the direction which is orthogonal to the nozzle row) is the second direction Y, and the layering direction of each member or the ejection direction of ink droplets is the third direction Z. In the present embodiment, each of the directions (X, Y, and Z) are orthogonal, but the arrangement relationship of each of the configurations is not necessarily limited an orthogonal configuration.

As shown in FIG. 4, the first head main body 2A includes a head chip 11 and a casing member 40. The head chip 11 is formed by a plurality of members such a flow path forming substrate 10, a linking plate 15, a nozzle plate 20, a protective substrate 30, and a compliance substrate 45 being layered.

The flow path forming substrate 10 is configured from a metal such as stainless steel (SUS), or nickel (Ni), a ceramic material which is represented by $ZrO_2$ or $Al_2O_3$, a glass ceramic material, an oxide such as MgO or $LaAlO_3$, and the like. In the present embodiment, the flow path forming substrate 10 consists of a silicon single crystal substrate. A plurality of rows of pressure generating chambers 12 which are partitioned using a plurality of partition walls are included along the first direction X on the flow path forming substrate 10 by carrying out anisotropic etching from a surface at one side (at the opposite side to the casing member 40). The rows of the pressure generating chambers 12 are lined up in two rows along the second direction Y. The pressure generating chambers 12 of the present embodiment are hollow sections with a long dimension in the second direction Y, and are formed in each nozzle 21.

The linking plate 15 is layered on the surface at one side of the flow path forming substrate 10. The linking plate 15 of the present embodiment has an area larger than the flow path forming substrate 10 on the (X and Y) surface, that is, in planar view. A nozzle linking path 16 which links the pressure generating chamber 12 and the nozzle 21 is formed for each nozzle 21 on the linking plate 15. It is possible to separate a distance between the nozzle 21 and the pressure generating chamber 12 by including such a linking plate 15. Thereby, it is possible to suppress influence of thickening being imparted on ink inside the pressure generating chamber 12 even if ink in the vicinity of the nozzle 21 is thickened due to evaporation of water which is included in the ink in the vicinity of the nozzle 21.

In addition, as shown in FIG. 4, a first manifold section 17 and a second manifold section 18 which configure a portion of the manifold 100 are formed on the linking plate 15. The first manifold section 17 is included so as to pass through the linking plate 15 in the thickness direction (the third direction Z). Meanwhile, the second manifold section 18 does not pass through the linking plate 15 in the thickness direction, and is included so as to be open to the nozzle plate 20 side in a form in which a thin-walled section remains at the flow path forming substrate 10 side. Furthermore, a supply linking path 19 which is linked to a side (the opposite side to the nozzle linking path 16) of the pressure generating chamber 12 in the second direction Y is included independently in each pressure generating chamber 12 on the linking plate 15. The second manifold section 18 and the pressure generating chamber 12 are inked by the supply linking path 19. That is, in the present embodiment, the supply linking path 19, the pressure generating chamber 12, and the nozzle linking path 16 are formed as individual flow paths which correspond to each nozzle 21.

It is possible to use a metal such as stainless steel (SUS), or nickel (Ni), a ceramic such as zirconium (Zr), or the like as such a linking plate 15. Here, the linking plate 15 is preferably a material with an equal linear expansion coefficient to the flow path forming substrate 10. That is, in a case where a material is used for the linking plate 15 with a greatly different linear expansion coefficient to the flow path forming substrate 10, warping is generated due to a difference in the linear expansion coefficients of the flow path forming substrate 10 and the linking plate 15 due to heating and cooling. In the present embodiment, warping due to heating, cracks due to heating, peeling, or the like are suppressed by using the same material as the flow path forming substrate 10, that is, a silicon crystal substrate as the linking plate 15.

The nozzle plate 20 is layered on the surface at the opposite side to the flow path forming substrate 10 of the linking plate 15. The plurality of nozzles 21 are established in rows along the first direction X at a pitch which corresponds to dot formation density on the nozzle plate 20. In the present embodiment, the nozzle rows (one type of nozzle group) are configured by 360 nozzles 21 included in rows at a pitch which corresponds to 360 dpi. The nozzles 21 are linked to each of the pressure generating chambers 12 via the nozzle linking path 16. That is, nozzles 21 which eject the same type of liquid (ink) are lined up in the first direction X, and the nozzle rows which are lined up in the first direction X are formed in two rows in the second direction Y.

The nozzle plate 20 of the present embodiment has an area smaller than the flow path forming substrate 10 and the linking plate 15 in planar view. In detail, the dimension of the nozzle plate 20 in the second direction Y is set as small as possible as long as it is possible to secure a joint edge where it is possible to link the nozzle linking path 16 and the nozzles 21 in a liquid-tight state. Thereby, it is possible to reduce the size of the nozzle plate 20, and it is possible achieve a reduction in costs. Here, in the present embodiment, the nozzles 21 on the nozzle plate 20 are open, and a surface from which ink droplets are discharged is referred to as a liquid ejection surface 20*a*.

It is possible to use, for example, a metal such as stainless steel (SUS), an organic material such as polyimide resin, a silicon crystal substrate, or the like as such a nozzle plate 20. Here, it is possible to make the linear expansion coefficients of the nozzle plate 20 and the linking plate 15 equal, and it is possible to suppress generation of warping due to heating or cooling, cracks due to heating, peeling, or the like by using the same material as the linking plate 15, that is, a silicon crystal substrate as the nozzle plate 20.

In addition, the compliance substrate 45 is included on a surface on the opposite side to the flow path forming substrate 10 of the linking plate 15, that is a surface to which the first manifold section 17 and the second manifold section 18 are open. The compliance substrate 45 is formed to have substantially the same size as the linking plate 15 in planar view, and a first exposure opening section 45*a*, of a size at which it is possible to expose the nozzle plate 20 inside the compliance substrate 45, is open. The compliance substrate 45 of the present embodiment is formed by a sealing film 46 and a fixed substrate 47 being layered. The sealing film 46 consists of a thin film which has flexibility (for example, a thin film with a thickness of 20 μm or less which is formed using polyphenylene sulfide (PPS) or the like), and the fixed substrate 47 is formed by a stiff material which consists of metal such as stainless steel (SUS). Since a region which opposes the manifold 100 of the fixed substrate 47 becomes an opening section 48 which is completely removed in the thickness direction, one surface (the lower surface) of the manifold 100 becomes a flexible compliance section 49 which is sealed only by the sealing film 46 which has flexibility. In the present embodiment, two compliance sections 49 are formed to interpose the nozzle plate 20 at both ends in the second direction Y corresponding to two manifolds 100.

A vibration plate 50 is layered at the opposite side to the linking plate 15 of the flow path forming substrate 10. The vibration plate 50 of the present embodiment is provided with an elastic film 51 which consists of silicon oxide which is included at the flow path forming substrate 10 side, and an insulation film 52 which consists of zirconium oxide which is included on the elastic film 51. The other surface (the surface on a piezoelectric element 130 side) of the pressure generating chamber 12 which is formed on the flow path forming substrate 10 is formed by the vibration plate 50. Then, the vibration plate 50 on which the pressure generating chamber 12 is formed is displaced up and down according to the change in shape of the piezoelectric element 130 which will be described later. Thereby, it is possible to vary the area of the pressure generating chamber 12.

The piezoelectric element 130 which is one type of actuator (pressure generating means) where a first electrode 60, a piezoelectric body layer 70, and a second electrode 80 are layered in this order is formed on the insulation film of the vibration plate 50. In general, either one electrode of the piezoelectric element 130 is set as a common electrode which is included so as to be contiguous across the plurality of pressure generating chambers 12, and the other electrode is set as an individual electrode which is included in each pressure generating chamber 12. That is, the individual electrode and the piezoelectric body layer 70 are patterned in each pressure generating chamber 12. Then, a portion of the piezoelectric body layer 70 which is interposed by both electrodes 60 and 80 becomes an active section in which piezoelectric strain is generated due to application of a voltage. In the present embodiment, the first electrode 60 is set as the common electrode, and the second electrode 80 is set as the individual electrode. For this reason, the first electrode 60 which is included so as to be contiguous across the plurality of pressure generating chambers 12 functions as one portion of the vibration plate. Here, the invention is not limited thereto, and the first electrode 60 may set as the individual electrode, and the second electrode 80 may be set as the common electrode due to the circumstances of the driving circuit or the wiring. In addition, the first electrode 60 may act alone as the vibration plate without including the elastic film 51 or the insulation film 52 described above. That is, the first electrode 60 may be included directly on the substrate (flow path forming substrate 10). However, in a case where the first electrode 60 is included directly on the flow path forming substrate 10, it is preferable to secure the first electrode 60 using an insulating protective film or the like such that there is no conduction between the first electrode and the ink. Here, on the substrate also includes a state of being directly on the substrate and interposed between other members (above). In addition, the piezoelectric element 130 may practically be set so as to also serve as the vibration plate.

Each of the end sections at one side (the opposite side to the supply linking path 19) of each of the second electrodes 80 which are individual electrodes are respectively connected to one end section of a lead electrode 90 which consists of, for example, gold (Au) or the like. The other end section of the lead electrode 90 is between the rows of the piezoelectric elements 130 which are formed in two rows, extends to a position which corresponds to a through hole 32 of the protective substrate 30, and is connected to wiring member 121 which includes a driving circuit 120. The wiring member 121 has a flexible sheet form, and it is possible to use, for example, a COF substrate or the like. Here, the driving circuit 120 need not be included in the wiring member 121. In other words, the wiring member 121 is not limited to the COF substrate, and may be an FFC, an FPC, or the like. In the present embodiment, one wiring member 121 is connected to the other end side of the lead electrode 90 which is pulled out from the row of the respective piezoelectric element 130. In this manner, it is possible to reduce the space in which the wiring member 121 and the lead electrode 90 are connected, and it is possible to achieve a reduction in size of the recording head 1 by including one wiring member 121 in the row of the piezoelectric element 130 which is lined up in two rows. Here, the number of the wiring members 121 is not limited to one, and the wiring members 121 may be included in each row of the piezoelectric element 130.

In addition, the protective substrate 30 which is substantially the same size as the flow path forming substrate 10 is joined at the surface at the piezoelectric element 130 side of the vibration plate 50. The protective substrate 30 has a holding section 31 which is a space for protecting the piezoelectric element 130. The holding section 31 is included independently in each row along the rows of the piezoelectric elements 130 which are included in the first direction X. In the present embodiment, the holding sections 31 are formed in two rows which correspond to the rows of the piezoelectric elements 130 which are formed in two rows. The through hole 32 which passes through in the thickness direction is included between the holding sections 31 which are formed in two rows. The other end of the lead electrode 90 is exposed to the inside of the through hole 32, and is electrically connected to the wiring member 121.

The casing member 40 which consists of resin, metal, or the like is fixed to the surface at the opposite side to the flow path forming substrate 10 of the protective substrate 30. The casing member 40 of the present embodiment is formed in substantially the same form as the linking plate 15 described above in planar view, and a concave section 41 with a depth such that it is possible to accommodate the flow path forming substrate 10 and the protective substrate 30 is formed inside the casing member 40. The concave section 41 has an opening area which is wider than the protective substrate 30 and the flow path forming substrate 10 in planar view. In addition, a portion which is a third manifold section 42 is formed outside of and is deeper than a portion in which the flow path forming substrate 10 and the protective substrate 30 of the concave section 41 are accommodated. Then, in a state in which the protective substrate 30, the flow path forming substrate 10, and the like are accommodated in the concave section 41, the inner surface (ceiling surface) of the concave section 41 of the casing member 40 and the upper surface of the protective substrate 30 are joined, and the bottom surface (surface at the nozzle plate 20 side) of the casing member 40 and the linking plate 15 are joined outside the protective substrate 30. Thereby, the opening surface at the nozzle plate 20 side of the concave section 41 is sealed by the linking plate 15. Here, it is possible to use resin, metal, or the like as the material of such a casing member 40. For example, it is possible to suppress mass production costs by producing the casing member 40 by forming from resin material.

Then, the third manifold section 42 is formed by the casing member 40, and the protective substrate 30 and the flow path forming substrate 10 at the outside (the opposite side to the nozzle row side) in the second direction Y of the flow path forming substrate 10. The third manifold section 42 links the first manifold section 17 and the second manifold section 18 which are included on the linking plate 15, and is configured by the manifold 100 of the present embodiment. That is, the manifold 100 includes the first manifold section 17, the second manifold section 18, and the third manifold section 42. The manifold 100 of the present embodiment is formed independently in two corresponding to the two rows of the pressure generating chamber 12 at the outside of the pressure generating chamber 12 in the second direction Y. That is, one manifold 100 is included in each row of the pressure generating chamber 12. In other words, the manifold 100 is included in each nozzle group. Each manifold 100 is configured such that ink is supplied respectively thereto, and that the same type of ink is ejected from the nozzle group which is linked to the same manifold 100. Here, it is possible for the manifold 100 to which the same type of ink is supplied to be linked inside the head main body 2.

In addition, an inlet 44 for supplying ink to each manifold 100 by being linked to the manifold 100, and a connection port 43 into which the wiring member 121 is inserted by being linked to the through hole 32 of the protective substrate 30 are included in the casing member 40. The inlet 44 of the present embodiment is included in each manifold 100. That is, a first inlet 44A which is linked to the manifold 100 which corresponds to one (the left side in FIG. 4) nozzle row, and a second inlet 44B which is linked to the manifold 100 which corresponds to the other (the right side in FIG. 4) nozzle row are included. Here, the first inlet 44A and the second inlet 44B are collectively referred to as the inlet 44. The connection port 43 is formed in a state in which the casing member 40 passes through in the third direction Z between the first inlet 44A and the second inlet 44B. The wiring member 121 is inserted into the connection port 43 and the through hole 32, that is, inserted in the third direction Z, and is connected to the piezoelectric element 130 via the lead electrode 90.

Then, in the first head main body 2A with such a configuration, when ink is ejected, the ink is taken in via the inlet 44, and a liquid flow path inner section from the manifold 100 reaching to the nozzle 21 is filled with the ink. After this, the piezoelectric element 130 and the vibration plate 50 are changed in shape by deflection due to voltage applied to each piezoelectric element 130 which correspond to the pressure generating chamber 12 according to a signal from the driving circuit 120. Thereby, the pressure within the pressure generating chamber 12 is varied, and ink droplets are ejected from the nozzle 21 by utilizing the pressure variation.

Here, in the present embodiment, the first head main body 2A is exemplified as an example of the head main body 2, but the invention is not particularly limited thereto. For example, although having substantially the same structure as the first head main body 2A described above, it is also possible to include a second head main body 2B where the manifold 100 is split into three in the first direction X in the recording head 1. In particular, the first head main body 2A and the second head main body 2B are respectively included in the recording head 1 of the present embodiment. Here, the first head main body 2A and the second head main body 2B are collectively referred to as the head main body 2.

Figure 5:
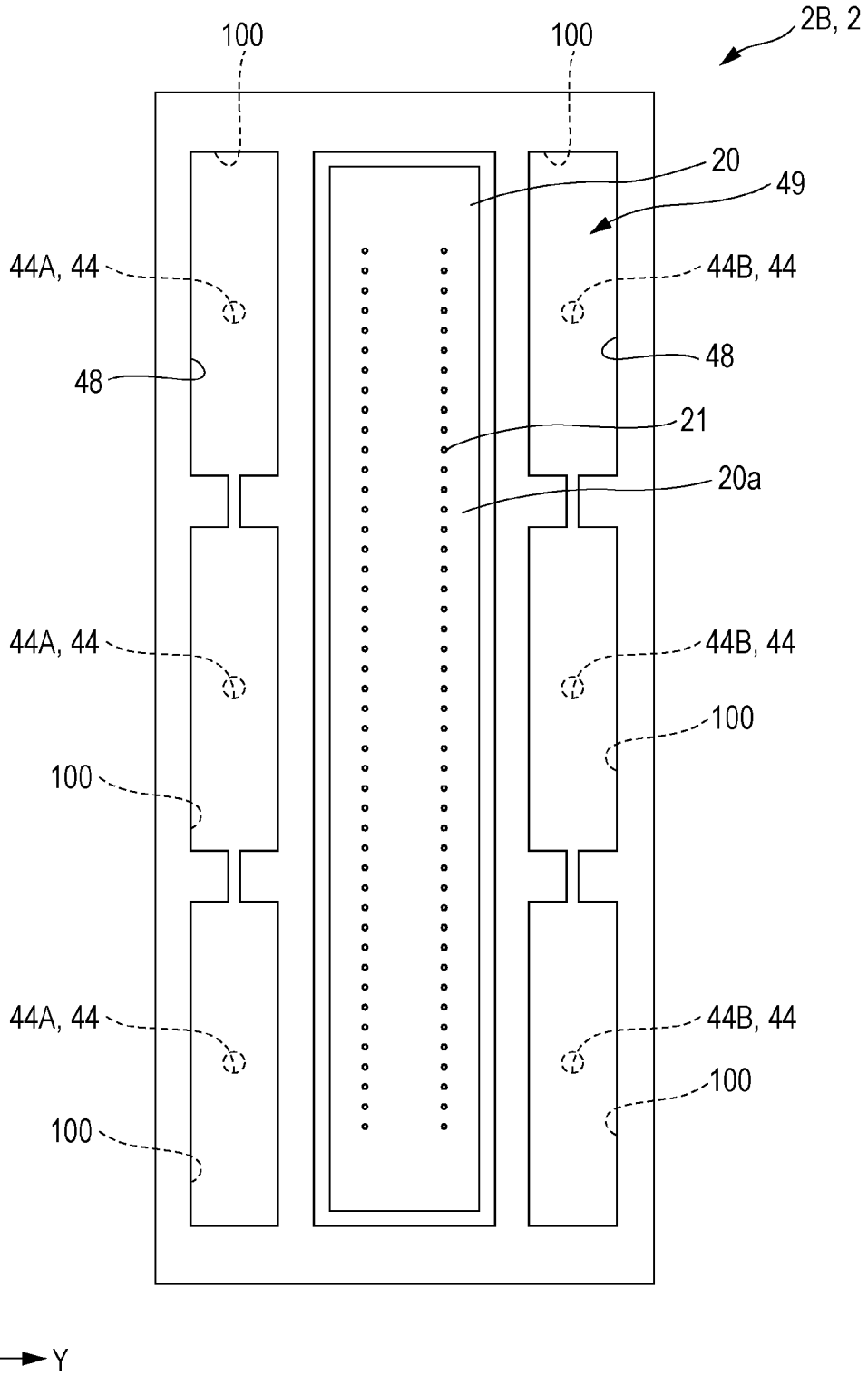
FIG. 5 is a planar diagram of a second head main body.

The second head main body 2B which is mounted in the recording head 1 of the present embodiment will be described with reference to FIG. 5. Here, FIG. 5 is a planar diagram illustrating the second head main body 2B. In the same manner as the first head main body 2A, in the second head main body 2B, the manifold 100 is included at both sides of the nozzle plate 20 on which the nozzle rows are formed in the second direction Y. The manifold 100 is respectively split into a plurality of sections (three in the present embodiment) in the first direction X. That is, two rows of three manifolds 100 lined up in the first direction X are included in the second direction Y, and a total of six manifolds 100 are included in the second head main body 2B of the present embodiment. In addition, the compliance section 49 (the opening section 48 of the compliance substrate 45) is formed in each of the manifolds 100 which are partitioned. Furthermore, the inlet 44 is respectively open to substantially the center of each manifold 100 in planar view. Accordingly, a row of the three inlets 44 which are lined up in the first direction X are provided in two rows in the second direction Y. Here, in the present embodiment, in the same manner to the first head main body 2A described above, one (the left side in FIG. 5) inlet 44 in the second direction Y is referred to as the first inlet 44A, and the other (the right side in FIG. 5) inlet 44 is referred to as the second inlet 44B. In addition, the other configuration of the second head main body 2B is omitted since the configuration is the same as the first head main body 2A.

Figure 6:
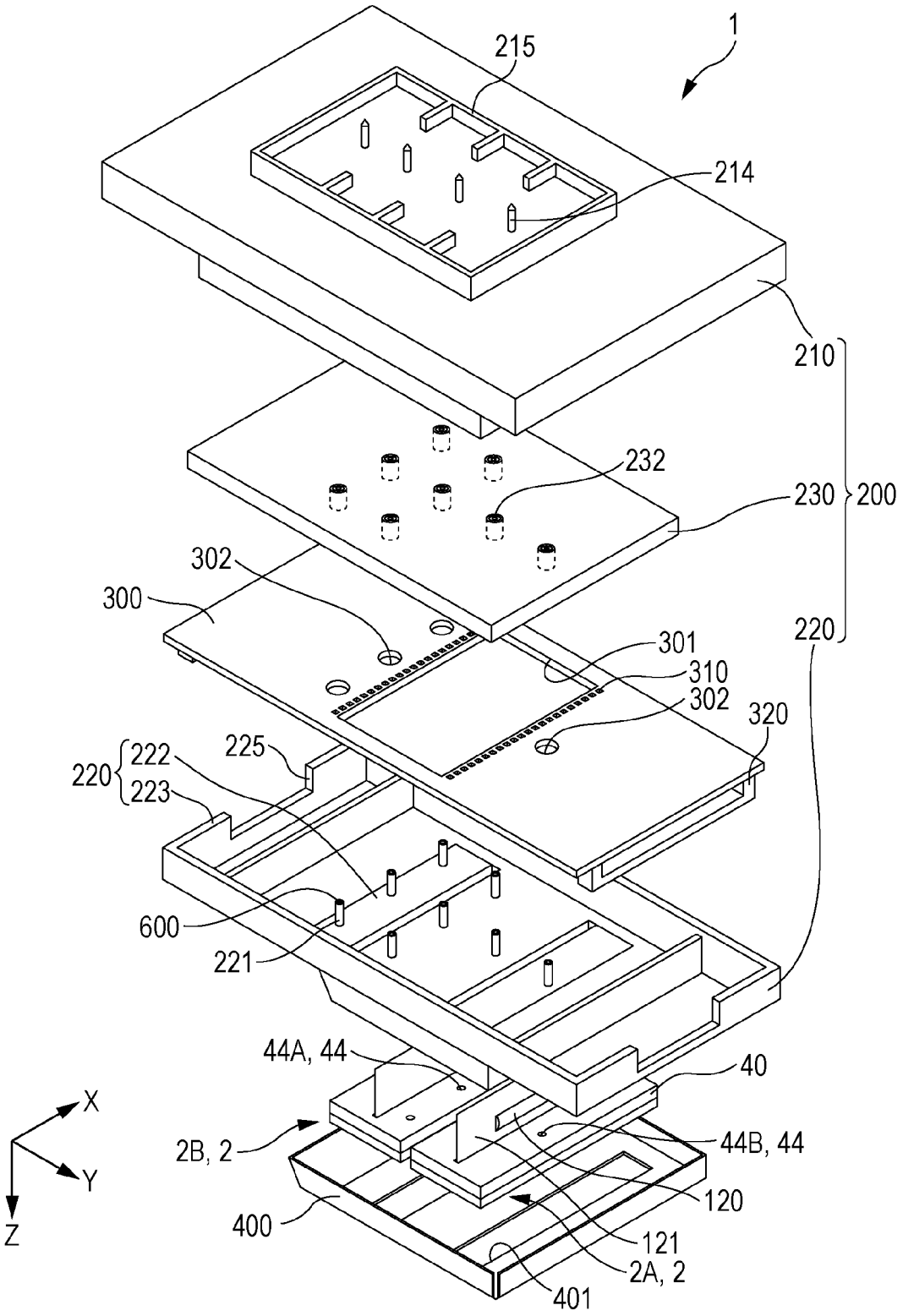
FIG. 6 is an exploded perspective diagram of a recording head.
Figure 7:
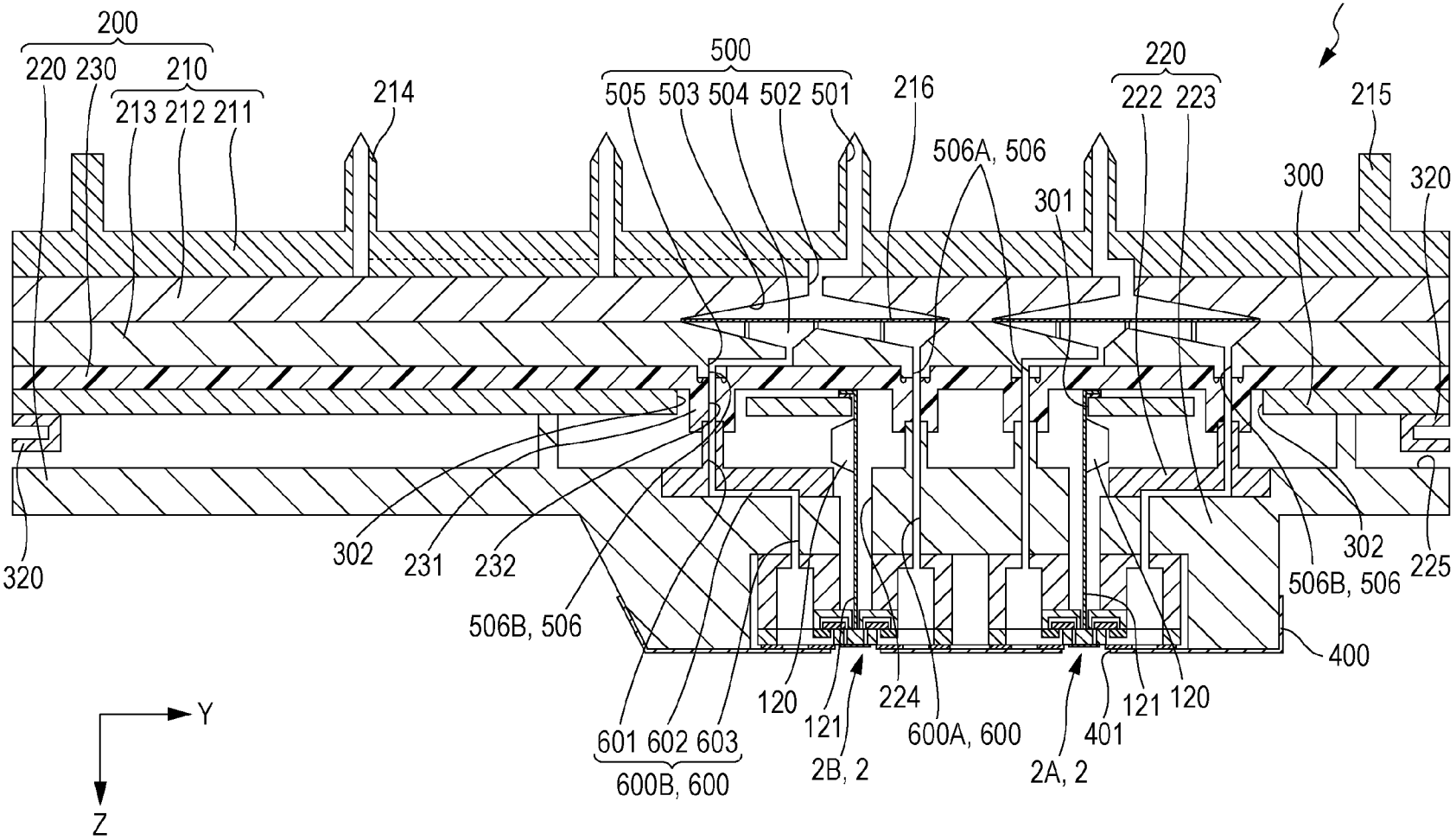
FIG. 7 is sectional diagram of the recording head.
Figure 8:
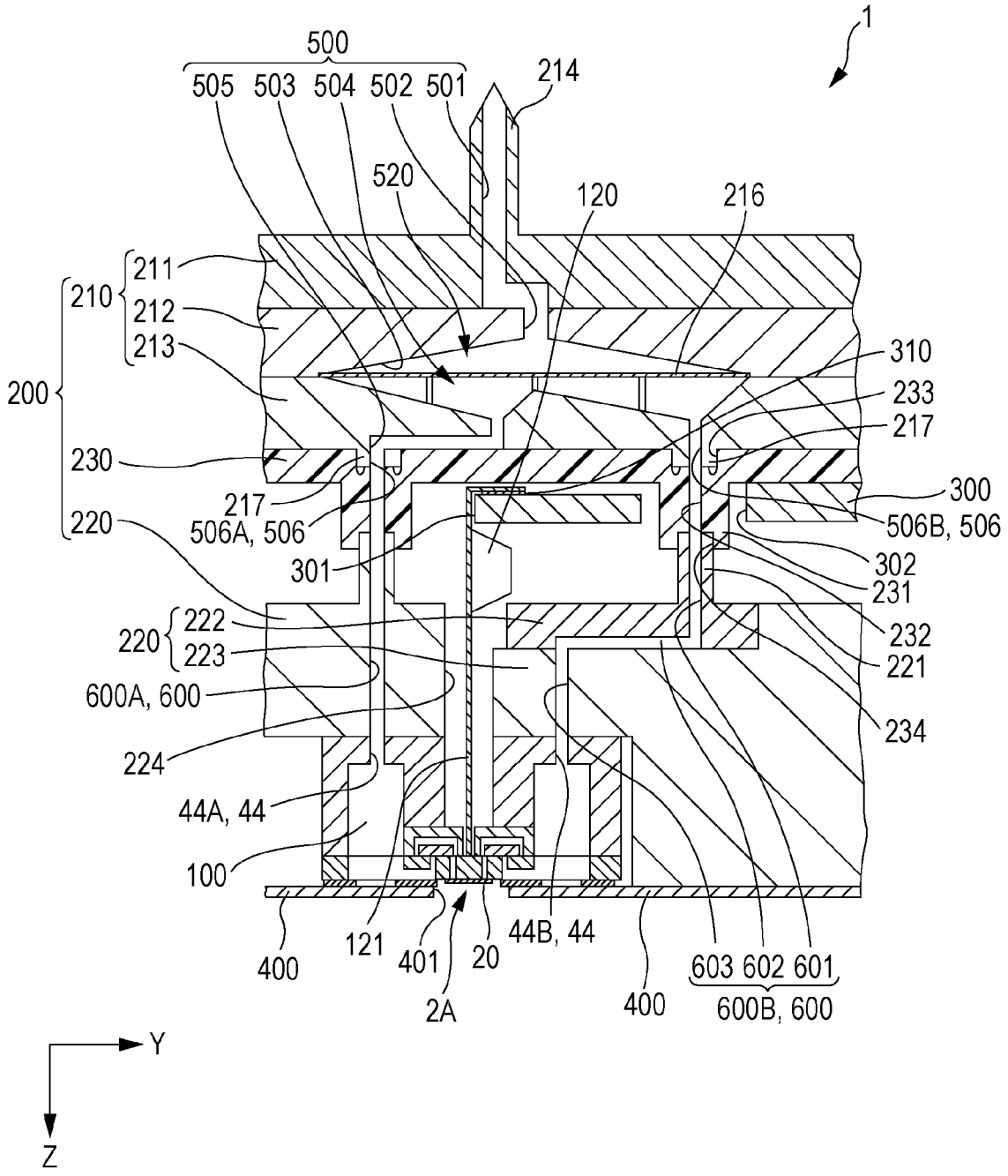
FIG. 8 is an enlarged sectional diagram of the main section of the recording head.

Next, the recording head 1 of the present embodiment which has such a first head main body 2A and second head main body 2B will be described in detail. Here, FIG. 6 is an exploded perspective diagram of the recording head 1, and FIG. 7 is sectional diagram of the recording head 1. FIG. 8 is an enlarged sectional diagram of the main section of the recording head 1.

As exemplified, the recording head 1 includes two head main bodies 2 (the first head main body 2A and the second head main body 2B) which eject ink droplets from the nozzles 21, a flow path unit 200 which holds the two head main bodies 2 and supplies ink to the head main bodies 2, a wiring board 300 which holds the flow path unit 200, and a cover head 400 which is included at the liquid ejection surface 20*a* side of the head main bodies 2.

As shown in FIG. 8, the flow path unit 200 includes an upstream flow path member 210 (equivalent to the flow path member in the invention) that includes an upstream flow path 500 including a filter chamber 520 inside which a filter 216 is arranged, a downstream flow path member 220 which includes a downstream flow path 600, and a sealing member 230 which connects the upstream flow path 500 and the downstream flow path 600 in a liquid-tight state.

The upstream flow path member 210 of the present embodiment is configured by a first upstream flow path member 211, a second upstream flow path member 212, and a third upstream flow path member 213 which are layered in the third direction Z (a direction which is orthogonal to the first direction X and the second direction Y). In addition, a first upstream flow path 501, a second upstream flow path 502, the filter chamber 520 (an upstream filter chamber 503 and a downstream filter chamber 504), and a third upstream flow path 505 which configure the upstream flow path 500 are formed inside each member 211, 212, and 213. Here, the upstream flow path member 210 is not particularly limited thereto, and may be configured as a single member, or a plurality of members of two or more. In addition, the layering direction of the plurality of members which configure the upstream flow path member 210 is also not particularly limited, and may be the first direction X or the second direction Y.

As shown in FIG. 7 and FIG. 8, the first upstream flow path member 211 has a connecting section 214 which is connected to the ink cartridge 1A at the upper surface side (the opposite side to the downstream flow path member 220). The connecting section 214 of the present embodiment is a member with a hollow-needle form which is inserted inside the ink cartridge 1A, and ink which is retained inside the ink cartridge 1A passes through the first upstream flow path 501 which is formed internally, and is introduced to the second upstream flow path 502 which will be described later. Here, a liquid retention means of the ink cartridge 1A or the like may be directly connected to the connecting section 214, or a liquid retention means of an ink tank or the like may be connected via a supply pipe or the like such as a tube. Furthermore, a self-sealing valve may be included between the liquid retention means, the tube, or the like, and the connecting section 214, and a flow path within the self-sealing valve and the connecting section 214 may be connected. In addition, the connecting section 214 is not limited to a member with a needle form, and it is possible to adopt a configuration in which a porous member which is able to absorb ink from each of a supply side and a reception side of ink is included, and ink is transferred by being caused to contact the porous member. In either configuration, ink from the liquid retention means is introduced inside the recording head 1 via the first upstream flow path 501 which is provided inside the connecting section 214. Here, the first upstream flow path 501 is configured by a flow path which extends in the third direction Z, a flow path which extends in a direction that is orthogonal to the third direction Z, that is, a (X and Y) plane direction, or the like according to the position of the second upstream flow path 502. In addition, a guide wall 215 for positionally aligning the ink cartridge 1A is provided in the periphery of the connecting section 214 of the first upstream flow path member 211 of the present embodiment.

The second upstream flow path member 212 is fixed to the lower surface side (the opposite surface side to the connecting section 214) of the first upstream flow path member 211. The second upstream flow path 502 (equivalent to the first liquid flow path in the invention) which is linked to the first upstream flow path 501 and the upstream filter chamber 503 (equivalent to the first space in the invention) which configures the upstream side of the filter chamber 520 with an inner diameter which is wider than the second upstream flow path 502 at a side further downstream (the third upstream flow path member 213 side) than the second upstream flow path 502 are formed inside the second upstream flow path member 212. In addition, the third upstream flow path member 213 is fixed to the lower surface side (the opposite surface side to the first upstream flow path member 211) of the second upstream flow path member 212. The third upstream flow path 505 (equivalent to the second flow path member in the invention) which configures the downstream side of the filter chamber 520 and which is open to the downstream filter chamber 504 (equivalent to the second space in the invention) which is linked to the upstream filter chamber 503 via the filter 216, and a bottom surface 504*a* at the opposite side to the upstream filter chamber 503 (the filter 216) of the downstream filter chamber 504 is formed inside the third upstream flow path member 213. The filter 216 which is arranged in the filter chamber 520 is a member for removing bubbles and foreign matter that is included in ink, and in the present embodiment, is fixed to an opening edge at the upstream side of the downstream filter chamber 504. The filter chamber 520 (the upstream filter chamber 503 and the downstream filter chamber 504) and the filter 216 will be described later in detail.

Here, the third upstream flow path 505 may have a plurality of openings with respect to the bottom surface 504*a* of the downstream filter chamber 504, and in the present embodiment, the third upstream flow path 505 has two openings on the bottom surface 504*a*. In addition, a first projecting section 217 which protrudes downwards is included on the lower surface (the surface at the downstream flow path member 220 side) of the third upstream flow path member 213. The first projecting section 217 is included respectively to correspond to each third upstream flow path 505, and a discharge port 506 which is at the downstream end of the third upstream flow path 505 is open to the respective leading end surfaces of the first projecting section 217. In the present embodiment, out of the two third upstream flow paths 505 which link to the one downstream filter chamber 504, the discharge port 506 which is at the downstream end of one (the left side in FIG. 8) third upstream flow path 505 is referred to as a first discharge port 506A, and the discharge port 506 which is at the downstream end of the other (the right side in FIG. 8) third upstream flow path 505 is referred to as a second discharge port 506B. That is, the upstream flow path 500 has two discharge ports 506 (the first discharge port 506A and the second discharge port 506B) at the downstream flow path member 220 side.

The first upstream flow path member 211, the second upstream flow path member 212, and the third upstream flow path member 213 which are included in such an upstream flow path 500 are, for example, integrally layered using an adhesive, by fusing, or the like. Here, it is possible to fix each upstream flow path member 211, 212, and 213 using a screw, clamp, or the like. However, from the viewpoint of securing liquid tightness in the connection portion from the first upstream flow path 501 to the third upstream flow path 505, it is preferable to join each upstream flow path member 211, 212, and 213 using an adhesive, by fusing, or the like. Thereby, it is possible to suppress ink from the connection portion of each upstream flow path member 211, 212, and 213 leaking. In addition, in the present embodiment, as shown in FIG. 6 and FIG. 7, since four connecting sections 214 are included on the upstream flow path member 210, corresponding thereto, four independent upstream flow paths 500 are included in the upstream flow path member 210. Then, since two third upstream flow paths 505 are open to the bottom surface 504*a* of the downstream filter chamber 504, that is, since each upstream flow path 500 is branched in two at the downstream side, a total of eight discharge ports 506 are included in the upstream flow path member 210.

The downstream flow path member 220 which is connected below the upstream flow path member 210 via the sealing member 230 includes the downstream flow path 600 which is connected to the upstream flow path 500. The downstream flow path member 220 of the present embodiment consists of a first downstream flow path member 222 and a second downstream flow path member 223. The upstream side of the downstream flow path 600 is included inside a second projecting section 221 which protrudes upwards from the upper surface (the surface at the upstream flow path member 210 side) of the downstream flow path member 220. Then, the upper end of the downstream flow path 600 is open to the leading end surface of the second projecting section 221, and is linked to the discharge port 506 via a linking flow path 232 of the sealing member 230 which will be described later. In the present embodiment, the downstream flow path 600 which links to the first discharge port 506A is referred to as a first connecting flow path 600A, and the downstream flow path 600 which links to the second discharge port 506B is referred to as a second connecting flow path 600B.

In addition, the lower end of the downstream flow path 600 is open to a surface at the opposite side to the upstream flow path member 210, and links to the inlet 44 of the head main body 2. In detail, the first connecting flow path 600A links to the first inlet 44A, and the second connecting flow path 600B links to the second inlet 44B. In the recording head 1 of the present embodiment, since the first head main body 2A which includes two inlets 44 (one of each of the first inlet 44A and the second inlet 44B) and the second head main body 2B which includes six inlets 44 (three of each of the first inlet 44A and the second inlet 44B) are included, corresponding thereto, four of each of the first connecting flow paths 600A and the second connecting flow paths 600B are included. Each downstream flow path 600 is configured by a flow path which extends in the third direction Z, a flow path which extends in a direction that is orthogonal to the third direction Z, that is, a (X and Y) plane direction, or the like, and the lower end section thereof is positionally aligned to be open to each inlet 44. As shown in FIG. 8, the first connecting flow path 600A of the present embodiment is formed in a straight line along the third direction Z. Meanwhile, the second connecting flow path 600B is configured from a first flow path 601 which extends in a straight line along the third direction Z from the second inlet 44B, a second flow path 602 which extends in the (X and Y) plane direction from the end section at the downstream side of the first flow path 601, and a third flow path 603 which extends in a straight line along the third direction Z from the end section at the downstream side of the second flow path 602 toward the second inlet 44B. Here, it is also possible to adopt a configuration in which the connecting flow path 600 is diagonally inclined with respect to the third direction Z, but as in the present embodiment, it is possible to achieve further reduction in size of the recording head 1 by adopting the configuration in which the second flow path 602 which extends in the (X and Y) plane direction is included since it is possible to reduce the space which the connecting flow path 600 occupies.

Here, the downstream flow path member 220 of the present embodiment consists of the first downstream flow path member 222 and the second downstream flow path member 223, and the second connecting flow path 600B is formed thereacross. In detail, the first flow path 601 is formed in the first downstream flow path member 222, the second flow path 602 is formed at a joining surface of the first downstream flow path member 222 and the second downstream flow path member 223, and the third flow path 603 is formed in the second downstream flow path member 223. By doing such, it is possible to easily form the second flow path 602 inside the downstream flow path member 220. Here, the first connecting flow path 600A is connected to the second downstream flow path member 223. In addition, a wiring member insertion hole 224 which links to the connection port of the head main body 2 and which links to the wiring member 121 is included between the first connecting flow path 600A and the second connecting flow path 600B of the downstream flow path member 220. Furthermore, a head accommodating space (which is omitted from the drawings) which accommodates the head main body 2 is formed on the lower surface of the second downstream flow path member 223.

The sealing member 230 which connects both flow paths 500 and 600 is included between the upstream flow path member 210 and the downstream flow path member 220 as a joint which joins the upstream flow path 500 and the downstream flow path 600. The sealing member 230 has ink resistance with respect to ink which used in the recording head 1, and consists of an elastically deformable material (elastic material). It is possible to use, for example, rubber, an elastomer, or the like as the sealing member 230. Then, a tubular portion 231 inside which the linking flow path 232 is included is formed in each downstream flow path 600 in the sealing member 230. Thereby, the upstream flow path 500 of the upstream flow path member 210 and the downstream flow path 600 of the downstream flow path member 220 are linked via the linking flow path 232 of the tubular portion 231. Here, an annular first concave section 233 into which the first projecting section 217 is inserted is included on the upper end surface (the end surface at the upstream flow path member 210 side) of the tubular portion 231. In addition, a second concave section 234 into which the second projecting section 221 is inserted is included on the lower end surface (the end surface at the downstream flow path member 220 side) of the tubular portion 231. Then, the tubular portion 231 is held between the leading end surface of the first projecting section 217 which is inserted into the first concave section 233 and the leading end surface of the second projecting section 221 which is inserted into the second concave section 234 in a state in which a prescribed pressure is applied in the third direction Z. In this manner, since the upstream flow path 500 and the linking flow path 232, and the linking flow path 232 and the downstream flow path 600 are connected in a state in which pressure is applied, the upstream flow path 500 and the downstream flow path 600 are linked via the linking flow path 232 in a liquid-tight state.

Here, in the present embodiment, since eight upstream flow paths 500 and downstream flow paths 600 are included, corresponding thereto, eight tubular portions 231 are integrally included in the sealing member 230. In addition, in the present embodiment, the upstream flow path 500 and the downstream flow path 600 are connected such that pressure is applied to the sealing member 230 in the third direction Z, but the invention is not limited thereto. For example, the inner circumferential surface of the first concave section 233 of the tubular portion 231 and the outer circumferential surface of the first projecting section 217, or the inner circumferential surface of the second concave section 234 of the tubular portion 231 and the outer circumferential surface of the second projecting section 221 may be adhered, and the flow paths may be connected by pressure being applied in the (X and Y) surface direction which is the diameter direction.

The wiring board 300 to which the wiring member 121 is connected is included between the sealing member 230 and the downstream flow path member 220. An insertion hole into which the wiring member 121 and the tubular portion 231 of the sealing member 230 are inserted is included on the wiring board 300. In the present embodiment, as shown in FIG. 6 and FIG. 7, a first insertion hole 301 into which the wiring member 121 and the tubular portion 231 which corresponds to the first connecting flow path 600A are inserted into, and a second insertion hole 302 into which the tubular portion 231 which corresponds to the second connecting flow path 600B is inserted into are included. The first insertion hole 301 is open to a center portion of the wiring board 300 in the second direction Y, and two wiring members 121 and four tubular portions 231 which correspond to four first connecting flow paths 600A that are included between the two wiring members 121 are inserted into the first insertion hole 301. In addition, the second insertion hole 302 is open to a both sides of first insertion hole 301 in the second direction Y of the wiring board 300, and the tubular portions 231 which are included that correspond to the second connecting flow paths 600B are respectively inserted into the second insertion hole 302. Here, in the present embodiment, one wiring board 300 which is common to two head main bodies 2 is included, but the invention is not limited thereto, the wiring board 300 may be included so as to be split for each head main body 2. As in the present embodiment, it is possible to simplify assembly work by reducing the number of components by using one wiring board 300 which is common to two head main bodies 2.

In addition, as shown in FIG. 6 and FIG. 8, a terminal section 310 which is connected to the wiring member 121 is formed in the opening edge section of the first insertion hole 301 at the upper surface (the surface at the upstream flow path member 210 side) of the wiring board 300. The upper end section of the wiring member 121 into which the first insertion hole 301 is inserted is bent along the upper surface of the wiring board 300, and is connected to the terminal section 310 of the wiring board 300. Furthermore, wirings, electronic components, and the like which are not shown in the drawings are mounted on the wiring board 300. The wiring which is connected to the terminal section 310 extends in the (X and Y) plane direction, and is connected to a connector 320 which is included at both end section sides of the wiring board 300 in the second direction Y. Then, an external wiring which is not shown in the drawings is connected to the connector 320. Here, a connector connection port 225 for exposing the connector 320 is included in the downstream flow path member 220. Thereby, it is possible to connect the external wiring to the connector 320.

Then, the first head main body 2A and the second head main body 2B are accommodated within the head accommodating space of the flow path unit 200 in a state of being lined up in the second direction Y. Here, the fixing method of the flow path unit 200 (the second downstream flow path member 223) and the head main body 2 is not particularly limited, and it is possible, for example, to adhere using adhesive, or fix using a screw or the like via the sealing member which consists of an elastic member. However, in a case where a plurality of small head main bodies 2 are fixed, since there is a difficulty in fixing via the sealing member which consists of the elastic member, it is preferable to fix the head main bodies 2 and the flow path unit 200 using the adhesive.

In addition, as shown in FIG. 6 to FIG. 8, the cover head 400 is attached at the lower surface side of the flow path unit 200. The cover head 400 of the present embodiment has a size so as to cover the plurality of head main bodies 2, is joined to the lower surface of the compliance substrate 45 of the head main bodies 2, and seals a space at the opposite side to the flow path (manifold 100) of the compliance section 49. In this manner, it is possible to suppress destruction of the compliance section 49 even if set to contact the recording medium S due to the compliance section 49 covering the cover head 400. In addition, it is possible to suppress ink from adhering to the compliance section 49, and furthermore, wipe away ink which is adhered to the surface of the cover head 400 using, for example, a wiper blade or the like. Thereby, it is possible to suppress the recording medium S from being made dirty by ink or the like which is adhered to the cover head 400. In addition, a second exposure opening section 401 which exposes the nozzles 21 is included on the cover head 400. The second exposure opening section 401 of the present embodiment has a size such that the nozzle plate 20 is exposed, that is, has substantially the same opening as the first exposure opening section 45*a* of the compliance substrate 45. Here, the cover head 400 of the present embodiment is included commonly to each head main body 2, but may be included independently to each head main body 2. In addition, a space between the cover head 400 and the compliance section 49 is open to the atmosphere via an atmosphere opening passage which is not shown in the drawings.

Figure 9:
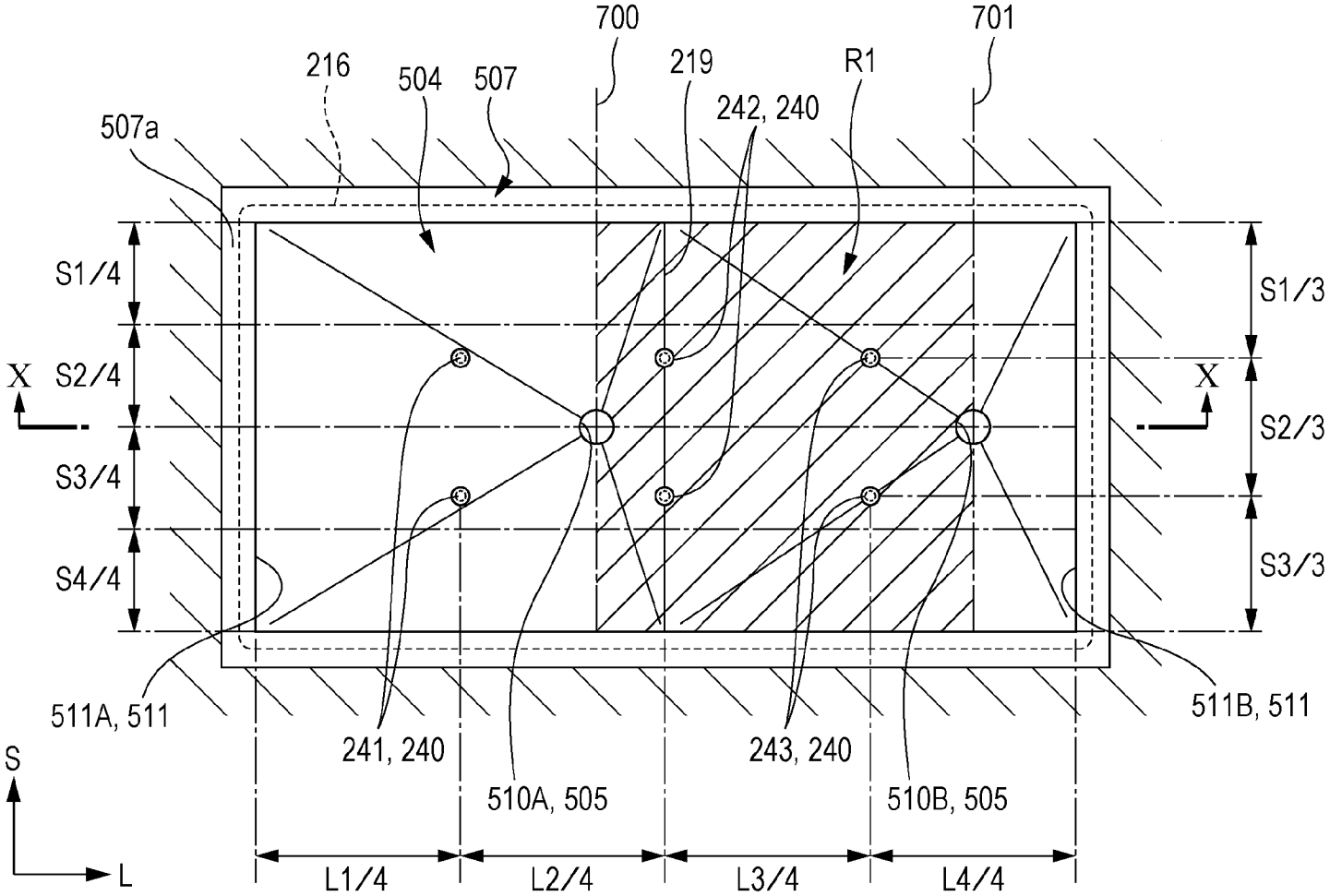
FIG. 9 is a planar diagram of a filter chamber of the first embodiment.
Figure 10:
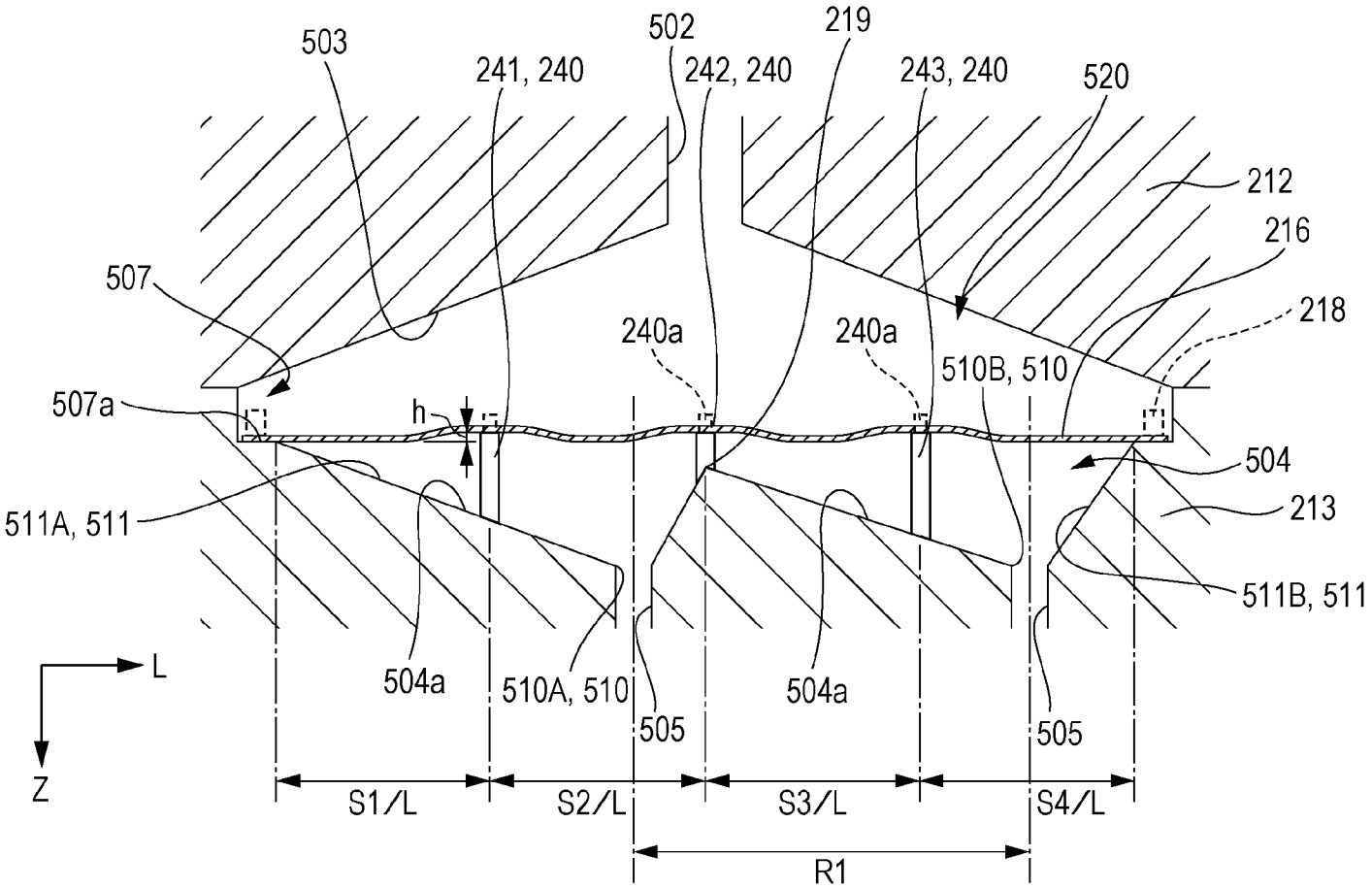
FIG. 10 is a sectional diagram of the filter chamber of the first embodiment.
Figure 11:
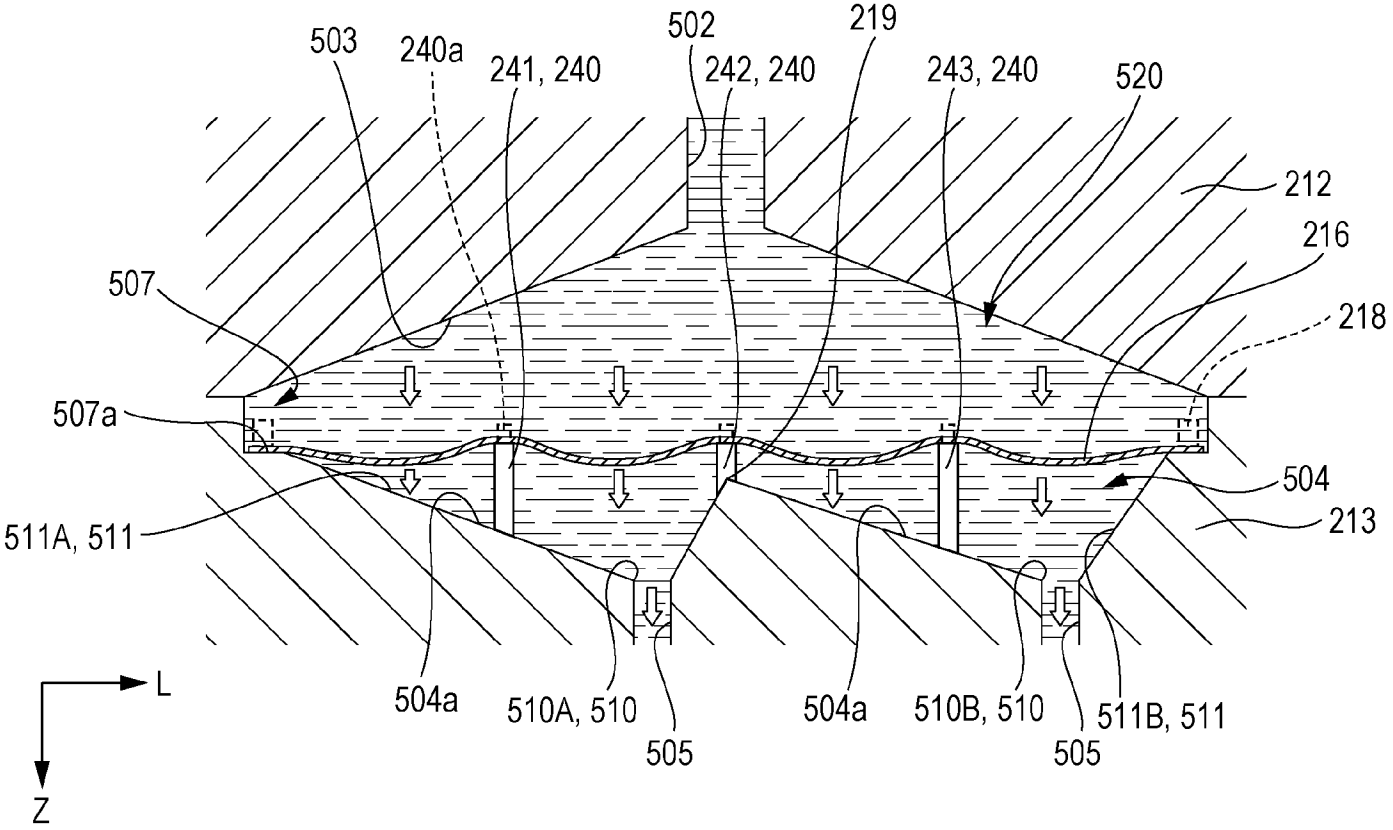
FIG. 11 is a sectional diagram of the filter chamber of the first embodiment.
Figure 12:
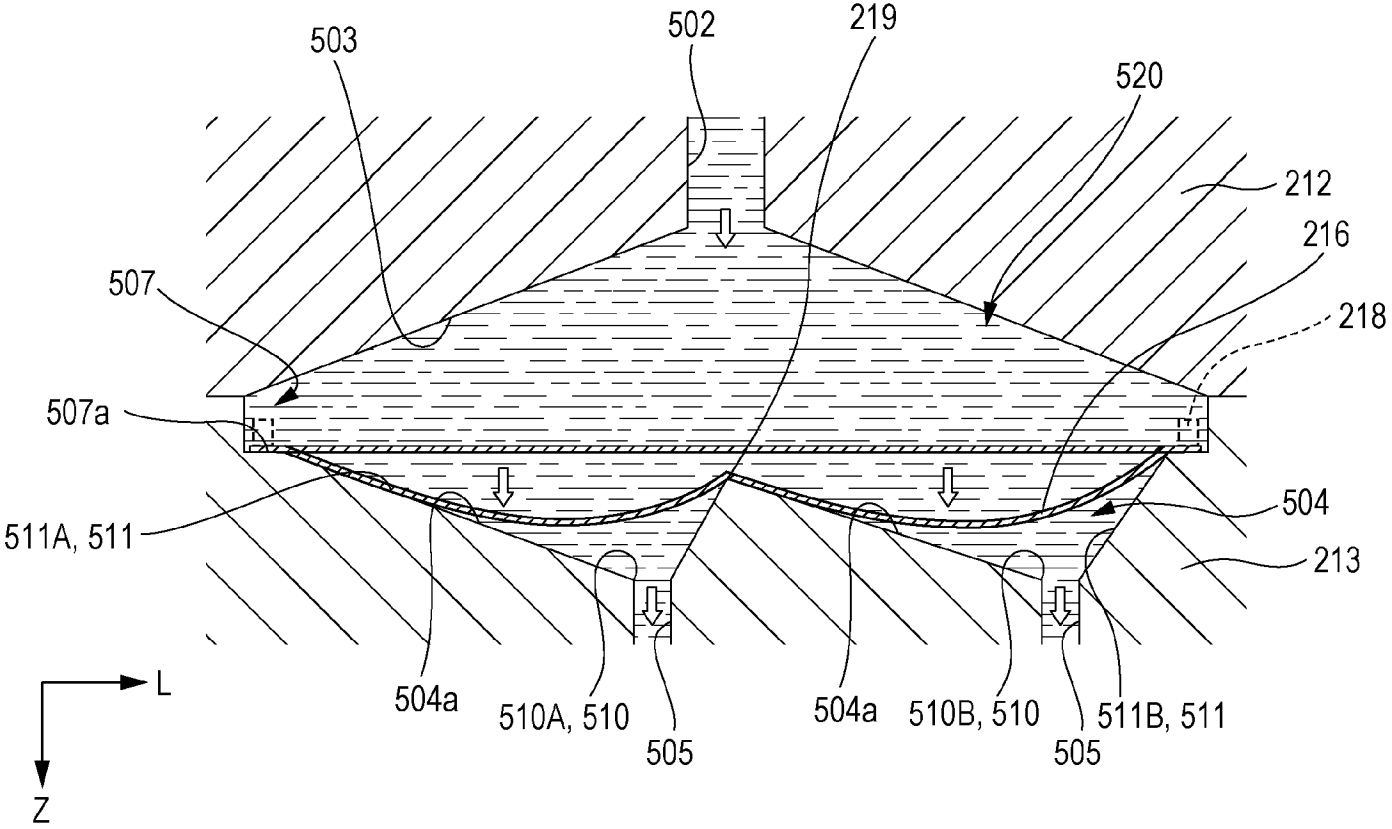
FIG. 12 is a sectional diagram of a filter chamber of the related art.
Figure 13A:
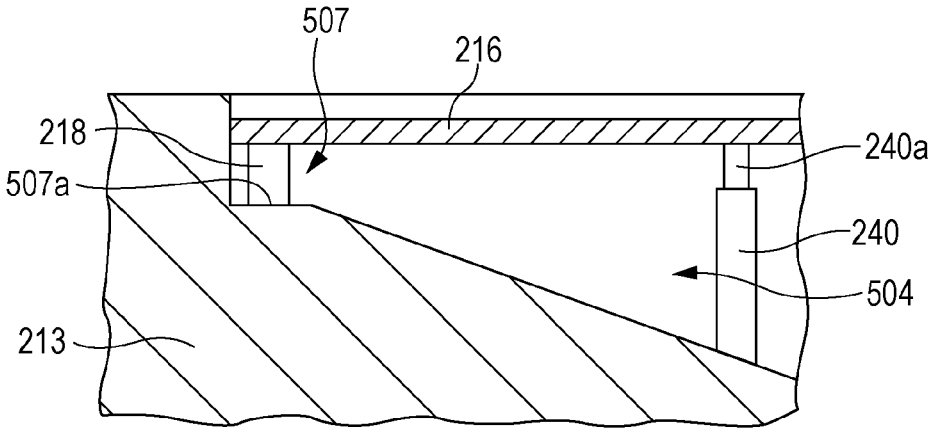
FIGS. 13A and 13B are enlarged sectional diagrams of the main section which explains fixing of the filter to the support in the first embodiment.
Figure 13B:
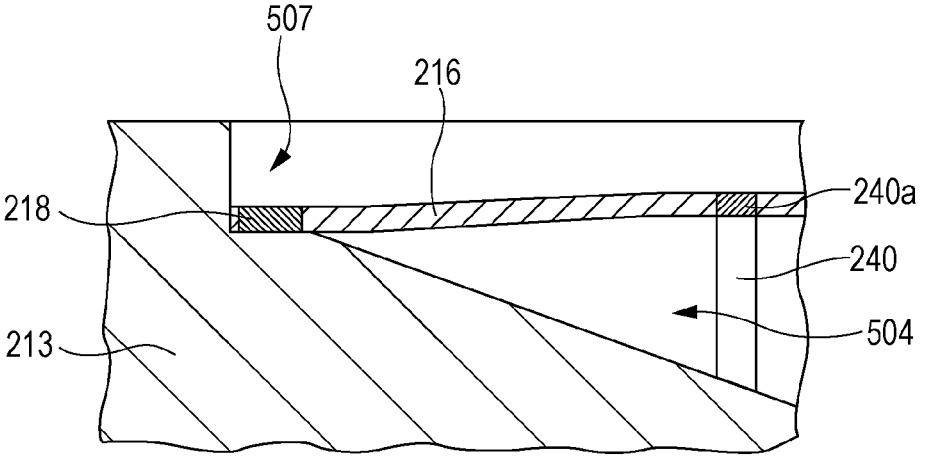
Figure 14A:
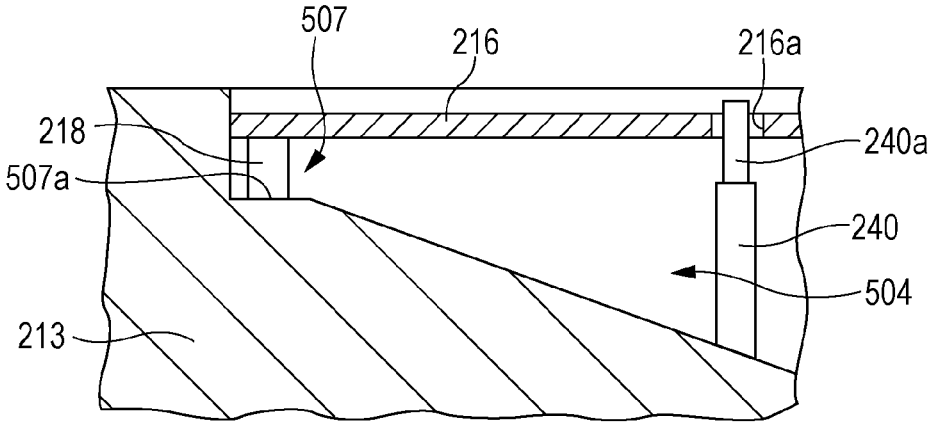
FIGS. 14A and 14B are enlarged sectional diagrams of the main section which explains fixing of the filter to the support in a first modification example of the first embodiment.
Figure 14B:
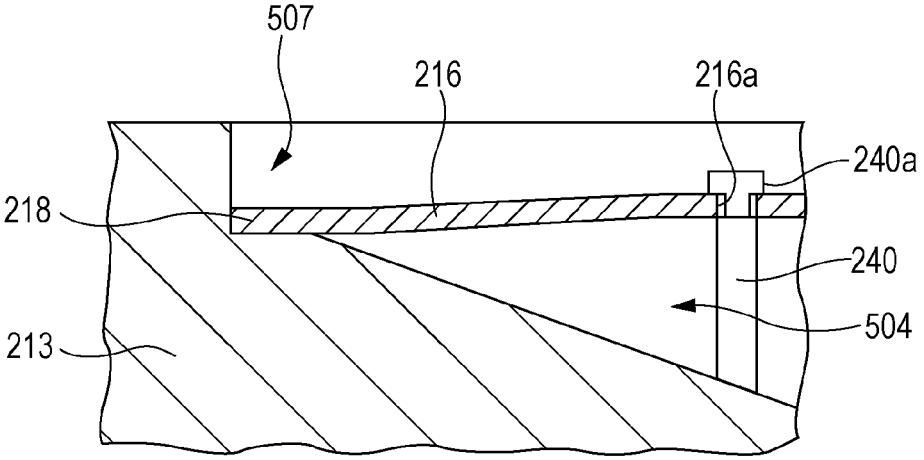

Next, the filter chamber 520 (the upstream filter chamber 503 and the downstream filter chamber 504) and the filter 216 of the first embodiment will be described in detail with reference to FIG. 9 to FIG. 14. FIG. 9 is a planar diagram of the filter chamber 520 of the present embodiment, and FIG. 10 is a sectional diagram along line X-X in FIG. 9. In addition, FIG. 11 is a sectional diagram of the filter chamber 520 in a state in which ink is flowing, and FIG. 12 illustrates a sectional diagram of a filter chamber 520 of the related art as a comparative example. Furthermore, FIGS. 13A and 13B are enlarged sectional diagrams of the main section which explains fixing of the filter 216 to the support 240 in the first embodiment. FIG. 13A is a schematic diagram illustrating a state before the filter 216 is fixed to the support 240, and FIG. 13B is a schematic diagram illustrating a state after the filter 216 is fixed to the support 240. In addition, FIGS. 14A and 14B are enlarged sectional diagrams of the main section which explains fixing of the filter 216 to the support 240 in a first modification example of the first embodiment. FIG. 14A is a schematic diagram illustrating a state before the filter 216 is fixed to the support 240, and FIG. 14B is a schematic diagram illustrating a state after the filter 216 is fixed to the support 240.

As shown in FIG. 10, the upstream filter chamber 503 which is formed in the second upstream flow path member 212 is open at a ceiling surface (the surface at the opposite side to the downstream filter chamber 504) of the upstream filter chamber 503 by the second upstream flow path 502. The upstream filter chamber 503 is expanded in diameter from the opening edge of the second upstream flow path 502 toward the downstream side (the filter 216 side), and the end section at the downstream side is open to the second upstream flow path member 212 side. That is, the ceiling surface of the upstream filter chamber 503 is slightly inclined from the opening edge at the filter 216 side toward the opening edge of the second upstream flow path 502. The second upstream flow path 502 of the present embodiment is open to substantially the center of the upstream filter chamber 503. In addition, the opening edge at the downstream side of the upstream filter chamber 503 is formed with substantially the same shape as a filter attachment space 507 (which will be described later) that is formed in the third upstream flow path member 213 in planar view. That is, the upstream filter chamber 503 of the present embodiment is formed in a rectangular form in planar view. Then, the upstream filter chamber 503 is linked to the downstream filter chamber 504 via the filter 216 which is attached to the filter attachment space 507.

As shown in FIG. 9, in the downstream filter chamber 504 of the present embodiment, the opening edge at the upstream side is formed in a rectangular form in planar view. As shown in FIG. 10, the filter attachment space 507 is formed further to the downstream side than the opening edge of the downstream filter chamber 504, that is, between the upstream filter chamber 503 and the downstream filter chamber 504. The filter attachment space 507 is formed with slightly larger inner dimensions than the opening edge of the downstream filter chamber 504. For this reason, a step is formed on the peripheral portion of the opening of the downstream filter chamber 504. The surface which opposes the upstream filter chamber 503 of the step is a filter attachment surface 507*a* to which the filter 216 is attached. A director 218 having thermoplasticity which protrudes to the second upstream flow path member 212 side is formed on the filter attachment surface 507*a* in a state before the filter 216 is attached. The filter 216 is fixed to the filter attachment surface 507*a* by being resolidified after the director 218 is melted by heat in a state in which the filter 216 is pressed against the director 218. Here, since the director 218 widens in the micropores and at the surface at the third upstream flow path member 213 side of the filter 216 after melting, the director 218 before melting is indicated by a broken line in FIG. 9, FIG. 10, and the like.

As shown in FIG. 9, the filter 216 which is attached to the filter attachment surface 507*a* is smaller than the inner diameter of the filter attachment space 507, and is formed in a rectangular form larger than the opening diameter of the downstream filter chamber 504 in planar view. That is, the outer form of the filter 216 is substantially the same as the form of the downstream filter chamber 504 (the opening section at the upstream side of the downstream filter chamber 504). Then, the opening section at the upstream side of the downstream filter chamber 504 is sealed by the filter 216. Here, a region within the filter 216 which opposes the opening section of the downstream filter chamber 504 is a region through which ink actually passes, and a portion of the outside of the region is a fixed portion which is fixed in the filter attachment space 507. The fixed portion of the filter 216 may have a different form to the opening edge of the downstream filter chamber 504. For example, a portion of the fixed portion of the filter 216 may be formed to be wide, and a portion of the fixed portion may protrude to the outside. However, when the width of the fixed portion widens excessively, there is a risk that the gap between the adjacent filters 216 widens and the upstream flow path member 210 increases in size in the long direction L and the in-plane direction of the short direction S. Accordingly, it is desirable to form the fixed portion of the filter 216 with as small an area as possible. That is, it is desirable to form the fixed portion of the filter 216 as small as possible at substantially the same width across the periphery of the region through which ink of the filter 216 passes.

Here, such a filter 216 may be any member as long as it is possible for ink to pass therethrough, that is, as long as it is possible to remove foreign matter such as dust and bubbles which is included in the ink. For example, it is possible to use a material with a sheet form where a plurality of micropores are formed by finely weaving fibers consisting of metal such as stainless steel (SUS), resin, or the like, or a material where a plurality of micropores are caused to pass through a plate-like member of metal, resin, or the like. In particular, it is easy to remove foreign matter from fibers consisting of metal which are woven into a mesh using a tatami weave or a twilled Dutch weave. For this reason, in the present embodiment, fibers consisting of stainless steel (SUS) of Dutch twill woven material are used as the filter 216. In addition, it is also possible to use a non-woven fabric or the like as the filter 216. Here, there is a risk that a material to which foreign matter easily catches, or a thin material as the filter 216 easily deflects to the downstream side. However, in the present embodiment, it is possible to widen the width of a selection of the filter 216 since a configuration is included in which deflection of the filter 216, which will be described later, is suppressed.

In addition, the third upstream flow path 505 is open to the bottom surface 504*a* of the downstream filter chamber 504 (the surface at the opposite side to the upstream filter chamber 503). In the present embodiment, two third upstream flow paths 505 are included, two opening sections 510 of the third upstream flow paths 505 are included at the bottom surface 504*a* of the downstream filter chamber 504. Here, one (the left side in FIG. 9, FIG. 10, and the like) opening section 510 is referred to as the first opening section 510A, and the other (the right side in FIG. 9, FIG. 10, and the like) opening section 510 is referred to as the second opening section 510B. As shown in FIG. 9, opening positions of the first opening section 510A and the second opening section 510B are aligned in the short direction S of the downstream filter chamber 504 (or the short direction S of the filter 216). Meanwhile, the opening position in the long direction L of the downstream filter chamber 504 (or the long direction L of the filter 216) is arranged so as to open a prescribed gap. In the present embodiment, as shown in FIG. 10, the opening position of the first opening section 510A and the second opening section 510B are eccentric in the in-plane direction of a surface parallel to the filter 216 ((X and Y) plane) with respect to the opening position of the second upstream flow path 502 which is open to upstream filter chamber 503. In detail, the first opening section 510A is formed near the center of the downstream filter chamber 504 within one region of the downstream filter chamber 504 which is equally divided into two in the long direction L. The second opening section 510B is formed near the opening edge at the other side (the opposite side to the center) of the downstream filter chamber 504 within the other region of the downstream filter chamber 504 which is equally divided into two in the long direction L.

Here, the short direction S of the downstream filter chamber 504 (or the short direction S of the filter 216) matches either one of the first direction X or the second direction Y in the recording head 1, and the long direction L of the downstream filter chamber 504 (or the long direction L of the filter 216) matches the other one. In addition, it is also possible to arrange the short direction S or the long direction L so as to become a direction which intersects with both the first direction X and the second direction Y in the (X and Y) plane.

A ridge 219 which is raised from the bottom surface 504*a* toward the filter 216 side is formed between the first opening section 510A and the second opening section 510B substantially in the center in the long direction L of the downstream filter chamber 504. The ridge 219 is formed in a straight line across from an end section at one side to an end section at the other side in the short direction S of the downstream filter chamber 504. In addition, the height from the opening section 510 of the ridge 219 is set such that the opening section 510 does not contact the filter 216 in a state in which the leading end of the ridge 219 does not deflect, that is, such that a gap is formed between the leading end of the ridge 219 and the filter 216, and is formed lower than the filter attachment surface 507*a*. According to the ridge 219, a recessed chamber 511 is partitioned into a first recessed chamber 511A to which the first opening section 510A is open at one side of the downstream filter chamber 504, and a second recessed chamber 511B to which the second opening section 510B is open at the other side of the downstream filter chamber 504. That is, it is possible to form the recessed chamber 511 in each opening section 510 by forming the ridge 219 between the adjacent opening sections 510. Then, the first recessed chamber 511A and the second recessed chamber 511B are linked by a gap which is formed between the leading end of the ridge 219 and the filter 216.

In addition, in each recessed chamber 511, the bottom surface 504*a* reduces in diameter from the upstream side (the filter 216 side) toward the opening section 510. That is, the bottom surface 504*a* of each recessed chamber 511 (downstream filter chamber 504) is slightly inclined from the filter 216 side toward the edge of each opening section 510. Thereby, it is possible to increase flow speed of ink which passes through the filter 216 at a position that is separated from the opening section 510, and it is possible to improve bubble discharge. In the present embodiment, since the opening positions of the first opening section 510A and the second opening section 510B are eccentric, the bottom surface 504*a* at the ridge 219 side is relatively steeper than the first opening section 510A of the first recessed chamber 511A, and the bottom surface 504*a* at the opposite side to the ridge 219 is relatively steeper than the second opening section 510B of the second recessed chamber 511B, and the bottom surface 504*a* at the opposite side to the ridge 219 is relatively gentler than the first opening section 510A of the first recessed chamber 511A, and the bottom surface 504*a* at the ridge 219 side is relatively gentler than the second opening section 510B of the second recessed chamber 511B.

In this manner, since two recessed chambers 511 are included in the downstream filter chamber 504 and the third upstream flow path 505 is linked to each of the recessed chambers 511, there is no need to include each of the downstream filter chamber 504 and the filter 216 corresponding to the third upstream flow path 505, and it is possible to reduce the number of components in comparison to a case where each filter 216 is included in each third upstream flow path 505. As a result, it is possible to reduce production costs. In addition, for example, in a case where the filter 216 is included in each second liquid flow path, there is a risk that the upstream flow path member 210 is increased in size since it is necessary to include the filter attachment surface 507*a* in each filter 216. Furthermore, there is a risk that the downstream filter chamber 504 becomes necessary in each filter 216, and the downstream filter chamber 504 increases in size by the partitioning wall section. In contrast to this, in the present embodiment, it is possible to reduce the size of the flow path member since there is no need to include a region in which the filter 216 is fixed (filter attachment surface 507*a*) to each second liquid flow path, a wall section which partitions the second liquid flow paths, or the like. Additionally, it is possible to utilize the filter 216 of a portion which opposes the ridge 219 since a gap is included between the ridge 219 which partitions the recessed chamber 511 and the filter 216. Thereby, it is possible to suppress the effective area of the filter 216 reducing in size. Then, it is possible increase flow speed of ink due to the inclination which is formed by the ridge 219, and it is possible to improve bubble discharge.

Here, since the ridge 219 is formed substantially in the center in the long direction L of the downstream filter chamber 504, the effective area of the filter 216 which opposes the first recessed chamber 511A and the effective area of the filter 216 which opposes the second recessed chamber 511B are aligned to be substantially the same. Thereby, it is possible to align pressure loss due to the filter 216 of ink which is supplied to the first opening section 510A and the pressure loss due to the filter 216 of ink which is supplied to the second opening section 510B to be substantially the same. Thereby, it is possible to suppress variance in pressure loss of ink which is supplied to the recording head 1.

In addition, for example, by reversing the relationship between the long sides and the short sides of the downstream filter chamber 504 of the configuration of the embodiment, it is also possible to partition the recessed chamber 511 into two using the ridge 219 which splits the downstream filter chamber 504 in the short direction S. However, in this case, the aspect ratio of the two recessed chambers 511 in the long direction L and the short direction S becomes large, and the difference in the distance from the filter 216 (opening peripheral edge of the recessed chambers 511) to the opening section 510 becomes large due to the location. For this reason, there is a risk that it becomes easy for variance in flow speed (or flow path resistance) of ink, which passes through the filter 216, toward the opening section 510 to occur, and bubbles are retained in the region where flow speed is slow. For this reason, as in the present embodiment, it is desirable to form the recessed chamber 511 by forming the ridge 219 in the center in the long direction L. By doing this, it is possible to suppress variance in flow speed of ink from the filter 216 toward the opening section 510.

Here, as shown in FIG. 12, in the case of the filter chamber 520 of the related art, there is a risk that the filter 216 changes shape by deflection to the bottom surface 504*a* side and sticks to the bottom surface 504*a* in a case where the filter 216 is pressed to the bottom surface 504*a* side of the downstream filter chamber 504 due to pressure of the ink which flows from the upstream filter chamber 503 toward the downstream filter chamber 504. In particular, as in the present embodiment, in a case where one filter 216 is included which is common to two third upstream flow paths 505, the area of the one filter 216 widens in comparison to a case where the filters 216 are individually included in each third upstream flow path 505. When the area of the filter 216 widens, it becomes easy for the filter 216 to stick to the bottom surface 504*a* of the downstream filter chamber 504 since the amount of deflection of the filter 216 increases during pressing. As a result, there is a problem in that the region which ink passes through becomes smaller, that is, the effective area of the filter 216 reduces in size and pressure loss increases. In addition, as in the present embodiment, when the opening section 510 is included so as to be eccentric from the center of the recessed chamber 511, variance of the flow speed of the ink from the upstream filter chamber 503 toward the opening section 510 becomes easy, and it becomes easy for pressure to be biased according to the filter 216. That is, pressing force according to the filter 216 is proportionally high, and it becomes easy for the filter 216 to further deflect. For this reason, from the viewpoint of suppressing flow speed of ink, it is considered that the opening section 510 of the third upstream flow path 505 is included substantially at the center of the recessed chamber 511, but there are cases where a member, for example, for convenience of design the downstream flow path member 220 or the like is included more to the downstream side than the upstream flow path member 210 in which the third upstream flow path 505 is included, and it is not possible to include the opening section 510 of the third upstream flow path 505 substantially at the center of the recessed chamber 511. In addition, the structure of other members is not limited to the design due to the opening section 510 being included substantially at the center of the recessed chamber 511, and there is a risk that production costs increase, or the size of the recording head 1 increases. For this reason, in the present embodiment, it is desirable to include the opening section 510 eccentrically from the center of the recessed chamber 511.

In the present embodiment, in order to solve the above problem, the support 240 is included on the bottom surface 504*a* of the downstream filter chamber 504 such that the filter 216 does not stick to the bottom surface 504*a* even if the filter 216 is pressed on the bottom surface 504*a* side due to variance or the like of flow speed of the ink. In detail, as shown in FIG. 10, the support 240 is a point form projection which protrudes from the bottom surface 504*a* of the downstream filter chamber 504 toward the filter 216 side. In the present embodiment, the support 240 is formed in a cylindrical form which protrudes upward along the third direction Z. It is desirable for the sectional area of the support 240 to be sufficiently small with respect to the area of the filter 216 (opening area at the upstream side of the downstream filter chamber 504), and it is further desirable for the area of the filter 216 to be sufficiently smaller than the area of the inner diameter of the flow path at the downstream side. In the present embodiment, the sectional area of the support 240 is formed so as to be half or less of the area (that is, the opening area of the opening section 510) of the inner diameter of the third upstream flow path 505. Thereby, it is difficult for bubbles to catch on the support 240, and bubble discharge is improved. In addition, it is possible to reduce the size of bubbles that are able to catch on the support 240. Thereby, it is possible to suppress impeding of flow of the flow path at the downstream side (the third upstream flow path 505) due to bubbles even if bubbles which are adhered to the support 240 flow toward the downstream side during ejection of ink.

Then, a welding portion 240*a* which has thermoplasticity is included at the leading end section of the support 240. The leading end section of the support 240 is fixed to the filter 216 by the welding portion 240*a*. In detail, the support 240 is fixed to the filter 216 due to resolidification after the welding portion 240*a* is melted by heat in a state in which the filter 216 is pressed on the welding portion 240*a*. Thereby, the lower surface of the filter 216 (the surface at the downstream filter chamber 504 side) comes to be in the state of being supported on the support 240. Here, since the welding portion 240*a* widens in the micropores of the filter 216 and at the leading end surface of the support 240, FIG. 10 indicates the welding portion 240*a* before fusing using a broken line. In addition, in the present embodiment, the fixing of the welding portion 240*a* and the filter 216 is performed in the same process as the director 218 to which an outer peripheral portion of the filter 216 is fixed. This point will be described later. Furthermore, the welding portion 240*a* of the present embodiment is formed in a cylindrical form with a smaller diameter than the diameter of the support 240, and protrudes upward from the leading end surface of the support 240. In addition, the upper end of the director 218 and the upper end of the welding portion 240*a* are aligned with substantially the same height in the state before fusing to the filter 216.

Then, the leading end surface of the support 240 on which the welding portion 240*a* is included (the leading end surface of the support 240 excluding the welding portion 240*a*) is included further upward (at the upstream filter chamber 503 side) than the lower surface of the filter 216 on the filter attachment surface 507*a*. Here, when an amount of protrusion h (refer to FIG. 10) from the lower surface of the filter 216, which is fixed to the filter attachment surface 507*a* of the leading end surface of the support 240, is excessively large, there is a risk that a gap between the filter 216 and the upstream filter chamber 503 becomes narrow, and the amount of bubbles which it is possible to hold on the filter 216 reduces. Thereby, the frequency at which a cleaning operation, in which bubbles are discharged, is performed increases, and consumption of ink increases. In addition, there is also a risk that the life of the recording head 1 is shortened. Furthermore, when the amount of protrusion h of the leading end surface of the support 240 is excessively large, there is a risk that the support 240 pierces the filter 216 when the filter 216 is pressed to the filter attachment surface 507*a* side. Meanwhile, when the leading end surface of the support 240 is included below the lower surface of the filter 216 which is fixed to the filter attachment surface 507*a*, there is a risk that the filter 216 sticks to the bottom surface 504*a* when the filter 216 is deflected due to pressure on the ink. For this reason, it is desirable for the leading end surface of the support 240 to be made to protrude below the lower surface of the filter 216 on the filter attachment surface 507*a*, and to make the amount of protrusion h lower than the amount of protrusion from the filter attachment surface 507*a* of the director 218.

In the present embodiment, as shown in FIG. 9, six such supports 240 are included within the downstream filter chamber 504. In detail, a set which is configured by two supports 240 which are lined up in the short direction S of the downstream filter chamber 504 is included at three locations at equal gaps in the long direction L of the downstream filter chamber 504. Here, the three sets of supports 240 which are lined up in the long direction L are arranged at a boundary position of each region when the downstream filter chamber 504 is divided into four equal regions in the long direction L. Here, the four equal regions, which the downstream filter chamber 504 is divided into in the long direction L, are set from one (the left side in FIG. 9) toward the other (the right side in FIG. 9) in order of L1/4, L2/4, L3/4, and L4/4. The support 240 which is included at the boundary of L1/4 and L2/4 is referred to as a first support 241. The support 240 which is included at the boundary of L2/4 and L3/4 is referred to as a second support 242. The support 240 which is included at the boundary of L3/4 and L4/4 is referred to as a third support 243. In addition, in the present embodiment, the first opening section 510A is included in L2/4, and the second opening section 510B is included in L4/4. For this reason, a region R1 which is interposed between the opening center of the first opening section 510A and the opening center of the second opening section 510B in the long direction L is a region from the middle of L2/4 to the middle of L4/4, and a set of the second support 242 and a set of the third support 243 are included within the region R1. That is, within the region which opposes the downstream filter chamber 504 of the filter 216, the set of the second support 242 and the set of the third support 243 are included within the region R1 between a line 700 along the short direction S which passes through the center of the first opening section 510A and a line 701 along the short direction S which passes through the center of the second opening section 510B. In addition, since the set of the second support 242 is formed at the center in the long direction L, as shown in FIG. 10, the set of the second support 242 is in a state of protruding from the leading end of the ridge 219. For this reason, it is possible to support the center section of the filter 216 in the long direction L using the set of the second support 242. Meanwhile, the set of the first support 241 is included in the region which includes the boundary between L1/4 and L2/4 which is away from the region R1.

Here, since in the filter 216 the center in the short direction S is most easily deflected, it is desirable that the support 240 be included at the center section in the short direction S. For example, in a case where the four equal regions which the downstream filter chamber 504 is divided into in the short direction S are set from one (the left side in FIG. 9) toward the other (the right side in FIG. 9) in order of S1/4, S2/4, S3/4, and S4/4, it is desirable that the set of the support 240 be included in the region of S2/4 and S3/4. Furthermore, in a case where the three equal regions which the downstream filter chamber 504 is divided into in the short direction S are set from one (the left side in FIG. 9) toward the other (the right side in FIG. 9) in order of S1/3, S2/3, and S3/3, it is further desirable that the set of the support 240 be included in the region of S2/3. In the present embodiment, the two supports 240 which are lined up in the short direction S which is configured by the set of each support 240 are within the region of S2/4 and S3/4, and are respectively included at the boundary of S1/3 and S2/3, and the boundary S2/3 and S3/3.

In this manner, since the support 240 is included on the bottom surface 504*a* of the downstream filter chamber 504, as shown in FIG. 11, it is possible to suppress the filter 216 from sticking on the bottom surface 504*a* even in a case where the filter 216 is pressed to the bottom surface 504*a* side due to pressure of the ink which flows from the upstream filter chamber 503 toward the downstream filter chamber 504. Thereby, it is possible to suppress the effective area (filtering execution area) of the filter 216 being reduced. In particular, in a case where solvent-based ink is used, it is possible for ink that has thickened into gel form to pass through the filter 216. When such a gel-form material is taken in further to the downstream side than the filter 216, the flow speed of a portion of the gel-form ink which is moved reduces, and bias in pressure is generated according to the filter 216. As a result, there is a risk that it becomes easy for the filter 216 to be pressed to the bottom surface 504*a* side, but even in such a case, it is possible to suppress deflection of the filter 216 by the support 240.

In addition, since deflection of the filter 216 is suppressed, it is possible to narrow the gap between the filter 216 and the bottom surface 504*a*, that is, it is possible to make the downstream filter chamber 504 shallower in the third direction Z, and it is possible to realize a reduction in height of the upstream flow path member 210, thus a reduction in height of the recording head 1. Furthermore, since the downstream filter chamber 504 is made shallower in the third direction Z, in comparison to a case where the downstream filter chamber 504 is deep in the third direction Z, it is possible to increase the flow speed of the ink and it is possible to improve bubble discharge. In addition, since the support 240 is included in the region R1 which is interposed between the first opening section 510A and the second opening section 510B in the long direction L, it is possible to more effectively suppress sticking on the bottom surface 504*a* due to deflection of the filter 216. In particular, since it is possible to include the support 240 in the center section in the long direction L, it is possible to support the center section in the long direction L of the filter 216 for which it is easy for the amount of deflection to increase. Furthermore, since the support 240 is formed in point form, it is difficult for bubbles to catch on the support 240 even if the bubbles are mixed in the downstream filter chamber 504. Thereby, it is difficult for bubbles to be retained inside the downstream filter chamber 504, and it is possible to improve discharge of bubbles. In addition, it is possible to suppress a reduction of the effective area of the filter 216 due to the support 240. As a result, it is possible to reduce the size of the filter 216.

In addition, since a plurality of supports 240 are included within the region R1, as shown in FIG. 11, the amount of deflection of the filter 216 to the bottom surface 504*a* side is reduced due to being split between the supports 240, and it is possible to more effectively suppress catching of the filter 216 on the bottom surface 504*a*. As a result, it is possible to suppress an increase in pressure loss due to catching of the filter 216 on the bottom surface 504*a* of the downstream filter chamber 504, and it is possible to suppress a meniscus of ink inside the nozzle 21 being destroyed. Additionally, since the support 240 is also included outside of the region R1, it is possible to more effectively suppress sticking on the bottom surface 504*a* due to deflection of the filter 216. That is, in the present embodiment, as shown in FIG. 11, since a change in shape by deflection of the filter 216 to bottom surface 504*a* side is dispersed in four regions L1/4, L2/4, L3/4, and L4/4 which are split by a first rib 241, a second rib 242, and a third rib 243, the amount of deflection of the filter 216 in each region is reduced, and it is possible to further effectively suppress sticking of the filter 216 to the bottom surface 504*a*. Here, if one support 240 is included within at least the region R1, it is possible to obtain an effect of suppressing sticking of the filter 216 on the bottom surface 504*a*, but it is possible to obtain a greater effect by also including a plurality of the supports 240 which are included outside the region R1.

Here, in a case where the leading end of the support 240 is not fixed to the filter 216, even if it is possible to obtain the effect described above, there is a risk that the leading end of the support 240 is scraped due to deflection of the filter 216, deviation due to expansion, or rubbing of the filter 216 and the support 240 which is caused by impacts, vibration, or the like due to external force. For this reason, there is a risk that foreign matter of the like which is scraped from the filter 216 or the support 240 is generated inside the downstream filter chamber 504, and flows through the opening section 510 to the downstream side. However, in the present embodiment, since the leading end of the support 240 is fixed to the filter 216, it is possible to prevent generation of foreign matter due to rubbing of the leading end of the support 240 and the filter 216.

The method of fixing the leading end of the support 240 to the filter 216 will be described below. As shown in FIG. 13A, the filter 216 is arranged on the director 218 of the filter attachment surface 507*a* and the welding portion 240*a* of the support 240. In this state, heat is applied while pressing from the upper surface (the opposite side to the bottom surface 504*a*) of the filter 216 downward using a thermocompression bonding jig. Thereby, as shown in FIG. 13B, the director 218 and the welding portion 240*a* are melted, and infiltrate into micropores of the filter 216. After this, the filter 216 is fixed on the filter attachment surface 507*a* and the leading end surface of the support 240 by fixing the melted director 218 to the welding portion 240*a*. In this manner, the director 218 and the welding portion 240*a*, for example, consist of a polyphenylene ether resin (PPE), polyethylene resin (PE), polystyrene resin (PS), polyamide resin (PA), a thermoplastic resin such as ABS resin, or a mixture of these, and are integrally formed with the support 240 and the third upstream flow path member 213. In the present embodiment, from the viewpoint of heat resistance, ink resistance, linear expansion, or the like, the third upstream flow path member 213 is formed using modified polyphenylene ether resin (m-PPE).

In this manner, since the welding portion 240*a* that has thermoplasticity is included in the leading end section of the support 240, it is possible to firmly and easily fix the filter 216 to the support 240. Here, in the present embodiment, since the leading end surface of the support 240 is positioned above the filter attachment surface 507*a*, as shown in FIG. 13B, the filter 216 is in a state of being pulled, and deflection of the filter 216 is further suppressed. In addition, it is also possible to adopt a method in which ultrasonic waves, a high frequency, or the like are used as the method in which heat is applied to the director 218 and the welding portion 240*a*. Furthermore, it is also possible to fix without including the director 218 and the welding portion 240*a* using an adhesive as the fixing method of the filter 216. However, since there is a concern that the adhesive deteriorates according to the liquid passing through the filter 216, for example, in the manner of liquid ink or the like, it is desirable to fuse the filter 216 using the director 218 and the welding portion 240*a* in the manner of the present embodiment.

In addition, the method in which the support 240 is fixed to the filter 216 is not limited to the method described above. For example, in the first modification example of the first embodiment shown in FIG. 14, in a state in which a fixing hole 216*a* is established in the filter 216 and the welding portion 240*a* is inserted in the fixing hole 216*a*, the leading end of the welding portion 240*a* is crimped. In detail, as shown in FIG. 14A, first, the filter 216 is arranged on the director 218 of the filter attachment surface 507*a*. At this time, the welding portion 240*a* which is included at the leading end of the support 240 is inserted into the fixing hole 216*a* which is established at a position which corresponds to the support 240 of the filter 216. In this state, heat is applied while pressing from the upper surface side of the filter 216 downward using the thermocompression bonding jig. Thereby, as shown in FIG. 14B, the director 218 is melted and infiltrates inside the micropores of the filter 216, and the leading end section of the welding portion 240*a* widens to be larger than the inner diameter of the fixing hole 216*a* along the upper surface of the filter 216. At this time, a portion of the melted welding portion 240*a* may infiltrate into the micropores of the filter 216. Then, it is possible to fix the filter 216 on the filter attachment surface 507*a* and the leading end surface of the support 240 by fixing the melted director 218 to the welding portion 240*a* in this state.

Figure 18:
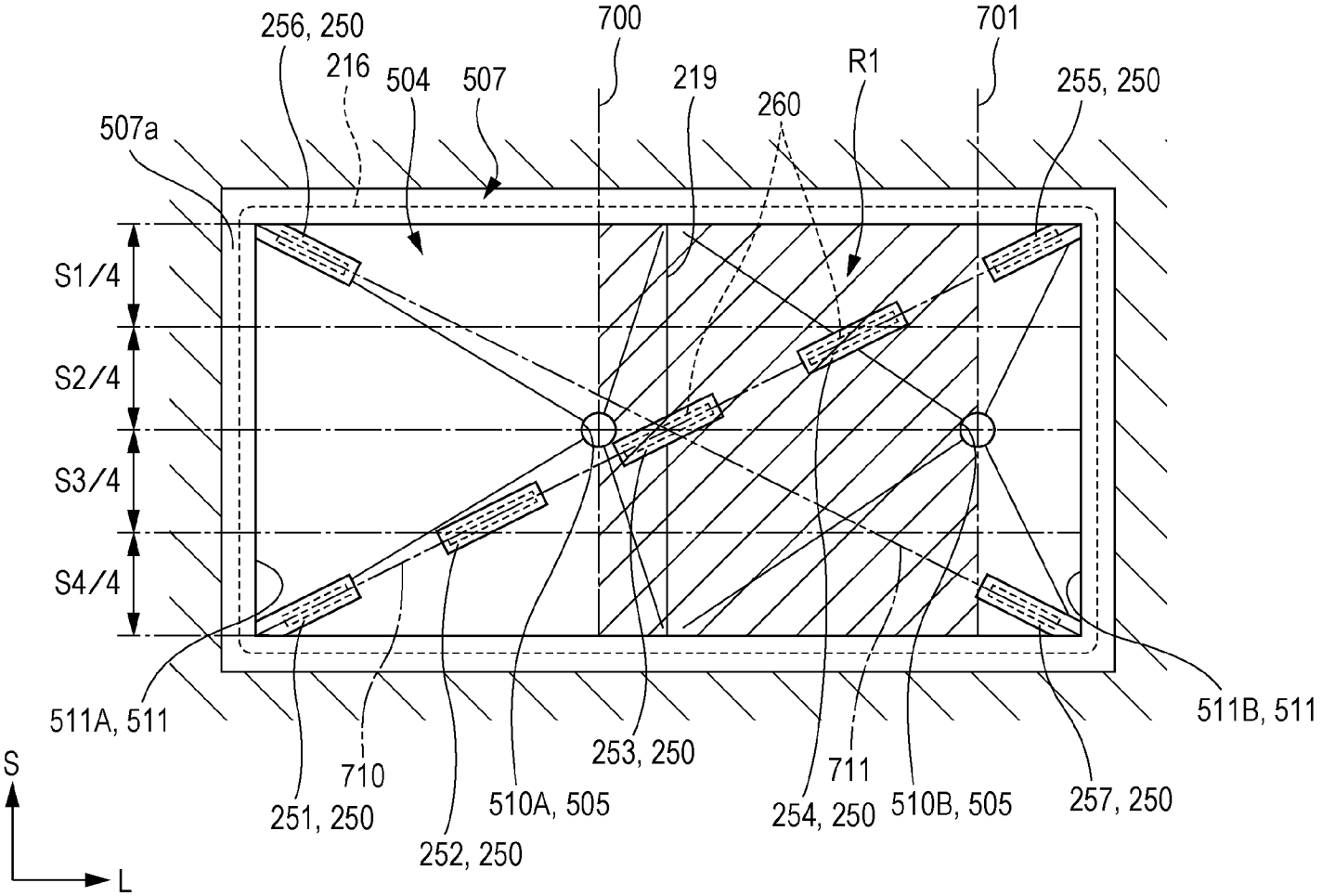
FIG. 18 is a planar diagram of a filter chamber of a third embodiment.

Here, in the first embodiment, the support 240 is formed in a cylindrical form, but may any form as long as a point form, that is, a columnar form. For example it is possible to form the support 240 in a polygonal form such as a triangular column or a square column. In addition, if the downstream filter chamber 504 is sectioned, for example, as in the third embodiment shown in FIG. 18, it is also possible to adopt the support 240 (a support wall 250) in a straight line (rectangular form) viewed from the upper surface. Here, the third embodiment will be described later. Furthermore, in the first embodiment above, two third upstream flow paths 505 are included with respect to one filter chamber 520, that is, two opening sections 510 are open with respect to one downstream filter chamber 504, but the invention is not limited thereto. It is also possible to open one opening section 510 with respect to one downstream filter chamber 504. In this case, as in the present embodiment, it is desirable for the opening of the second upstream flow path 502 and the opening (the opening section 510) of the third upstream flow path 505 to not oppose one another, and be eccentric in the (X and Y) plane direction. By doing this, degree of design freedom increases since there is no need to arrange an opening of the second upstream flow path 502 and an opening of the third upstream flow path 505 symmetrically opposite. That is, it is possible to arrange the second upstream flow path 502 and the third upstream flow path 505 by positionally aligning a flow path further to the upstream side than the second upstream flow path 502 and a flow path further to the downstream side than the third upstream flow path 505. In addition, it is possible to increase the effective area of the filter 216 since it is easy for ink which flows in from the opening of the second upstream flow path 502 to disperse and pass through the filter 216 in comparison to in a case where the opening of the second upstream flow path 502 and the opening of the third upstream flow path 505 are arranged symmetrically opposite. Furthermore, it is also possible to include an opening (the opening section 510) of a plurality of third upstream flow paths 505 with respect to one downstream filter chamber 504 according to the configuration of the recording head 1. For example, in the fourth embodiment shown in FIG. 20, three opening sections 510 are included with respect to one downstream filter chamber 504. Here, the fourth embodiment will be described later.

Figure 15:
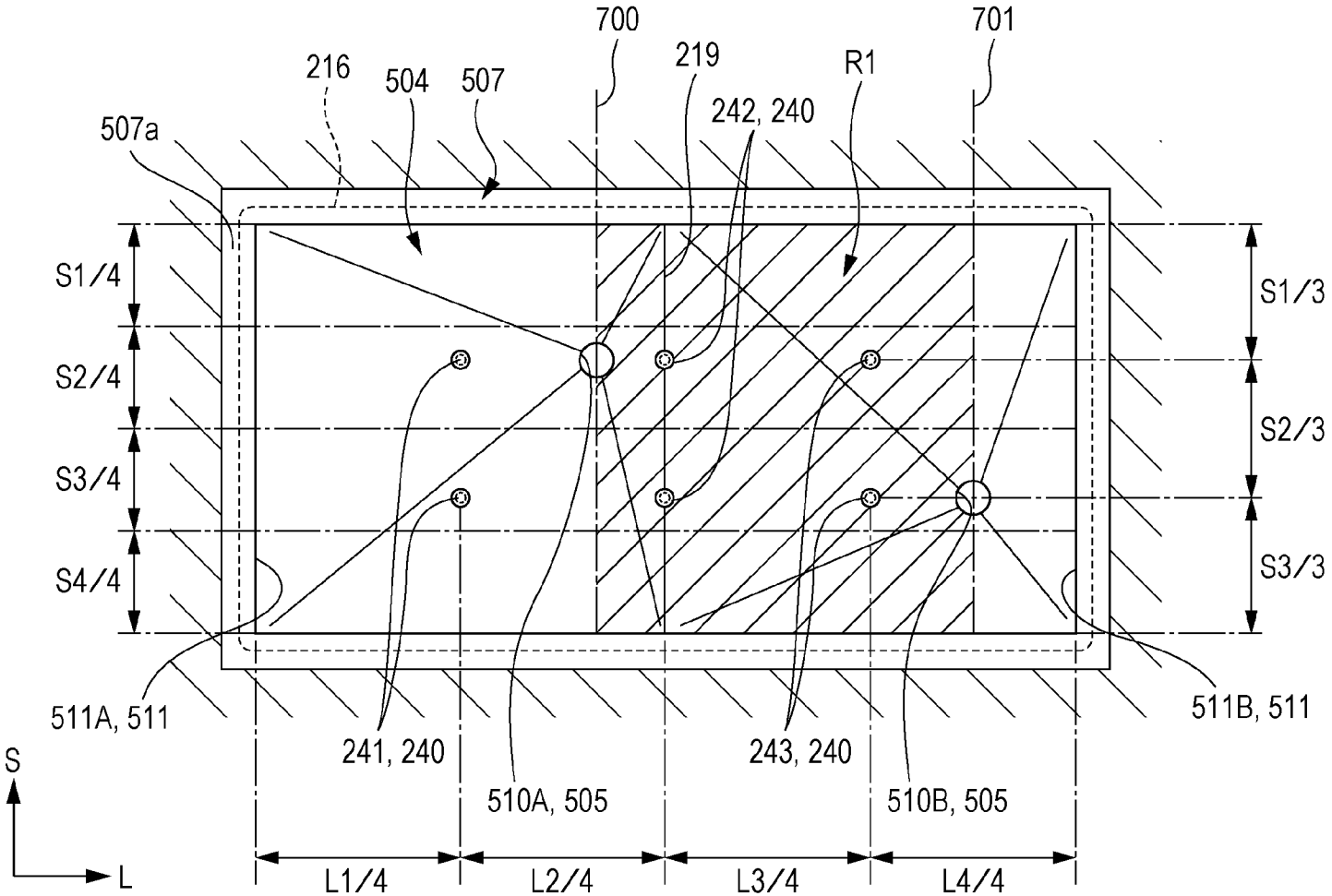
FIG. 15 is a planar diagram of a filter chamber in a second modification example of the first embodiment.

In addition, in the first embodiment described above, two opening sections 510 are aligned at the same position in the short direction S, but the invention is not limited thereto. For example, in the second modification example of the first embodiment shown in FIG. 15, the first opening section 510A and the second opening section 510B are arranged with a prescribed gap open in the short direction S. In detail, the first opening section 510A is included at a boundary of S1/3 and S2/3 within a region in which the downstream filter chamber 504 is equally divided into three in the short direction S. In addition, the second opening section 510B is included at a boundary of S2/3 and S3/3 within a region in which the downstream filter chamber 504 is equally divided into three in the short direction S. Here, the position of the first opening section 510A and the second opening section 510B in the long direction L is the same as in the first embodiment described above. Then, also in the present modification example, it is possible to more effectively suppress sticking on the bottom surface 504*a* of the downstream filter chamber 504 due to changing of shape by deflection of the filter 216 by including the support 240 (the second support 242 and the third support 243) in the region R1 which is interposed between the opening center of the first opening section 510A and the opening center of the second opening section 510B in the long direction L. Here, since other configurations are the same as the first embodiment described above, explanation is omitted.

Figure 16:
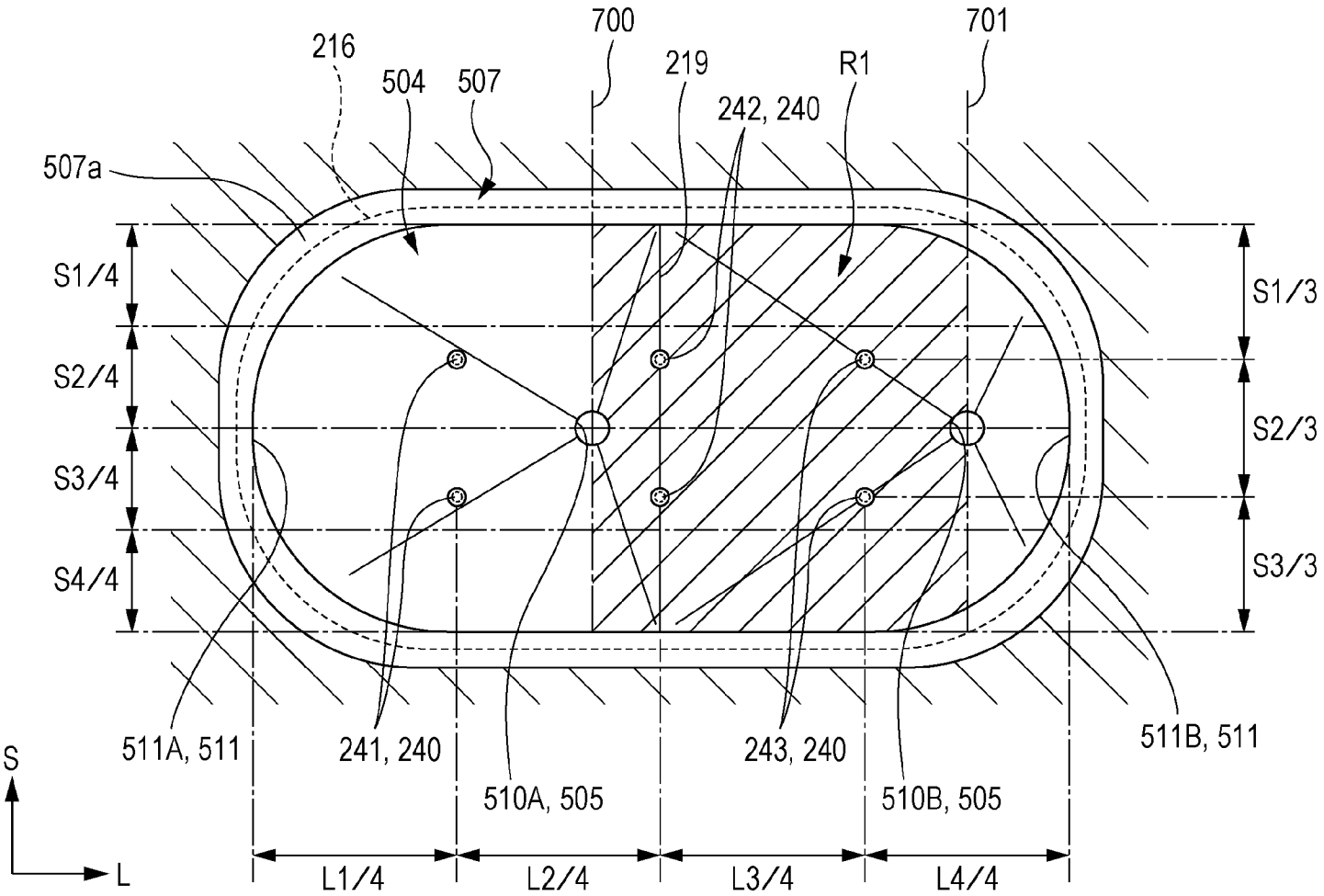
FIG. 16 is a planar diagram of a filter chamber of a second embodiment.

In addition, in the first embodiment described above, the outer form of the upstream filter chamber 503, the downstream filter chamber 504, the filter attachment space 507, and the filter 216 are formed in a rectangular form in planar view, but the invention is not limited thereto. For example, in the second embodiment shown in FIG. 16, the outer form of the upstream filter chamber 503, the downstream filter chamber 504, the filter attachment space 507, and the filter 216 are formed in an elliptical form. That is, the opening edge at the downstream side of the upstream filter chamber 503 and the filter attachment space 507 are formed in an elliptical form with substantially the same inner diameter, and the opening edge at the upstream side of the downstream filter chamber 504 is formed in an elliptical form with a slightly smaller inner diameter than the filter attachment space 507, In addition, the filter 216 is smaller than the inner diameter of the filter attachment space 507, and is formed with an elliptical form with a larger inner diameter than the opening edge at the upstream side of the downstream filter chamber 504. In this case, the direction along the axial direction of a long axis in the elliptical form is the long direction L, and the direction along the axial direction of a short axis in the elliptical form is the short direction S.

Then, also in the present embodiment, in the same manner as the first embodiment described above, the first opening section 510A is included in the region of L2/4, and the second opening section 510B is included in the region of L4/4 within the region in which the downstream filter chamber 504 is equally divided into four in the long direction L. In addition, two first supports 241 are included at the boundary of L1/4 and L2/4, two second supports 242 are included at the boundary of L2/4 and L3/4, and two third supports 243 are included at the boundary of L3/4 and L4/4. Furthermore, the two supports 240 arranged with a gap open in the short direction S are included at the boundary of S1/3 and S2/3 and at the boundary of S2/3 and S3/3 within the region in which the downstream filter chamber 504 is equally divided into three in the short direction S. That is, the set of the second support 242 and the set of the third support 243 are included within the region R1 and the set of the first support 241 is included in a region outside of the region R1 which is interposed between the opening center of the first opening section 510A and the opening center of the second opening section 510B in the long direction L.

In addition, also in the present embodiment, since a plurality of supports 240 are included within the region R1, the amount of deflection of the filter 216 to the bottom surface 504*a* side is reduced due to being split between the supports 240, and it is possible to more effectively suppress catching of the filter 216 on the bottom surface 504*a*. As a result, it is possible to suppress an increase in pressure loss due to catching of the filter 216 on the bottom surface 504*a* of the downstream filter chamber 504, and it is possible to suppress a meniscus of ink inside the nozzle 21 being destroyed. Additionally, since the support 240 is also included outside of the region R1, it is possible to more effectively suppress sticking on the bottom surface 504*a* due to deflection of the filter 216. Here, since other configurations are the same as the first embodiment described above, explanation is omitted.

Figure 17:
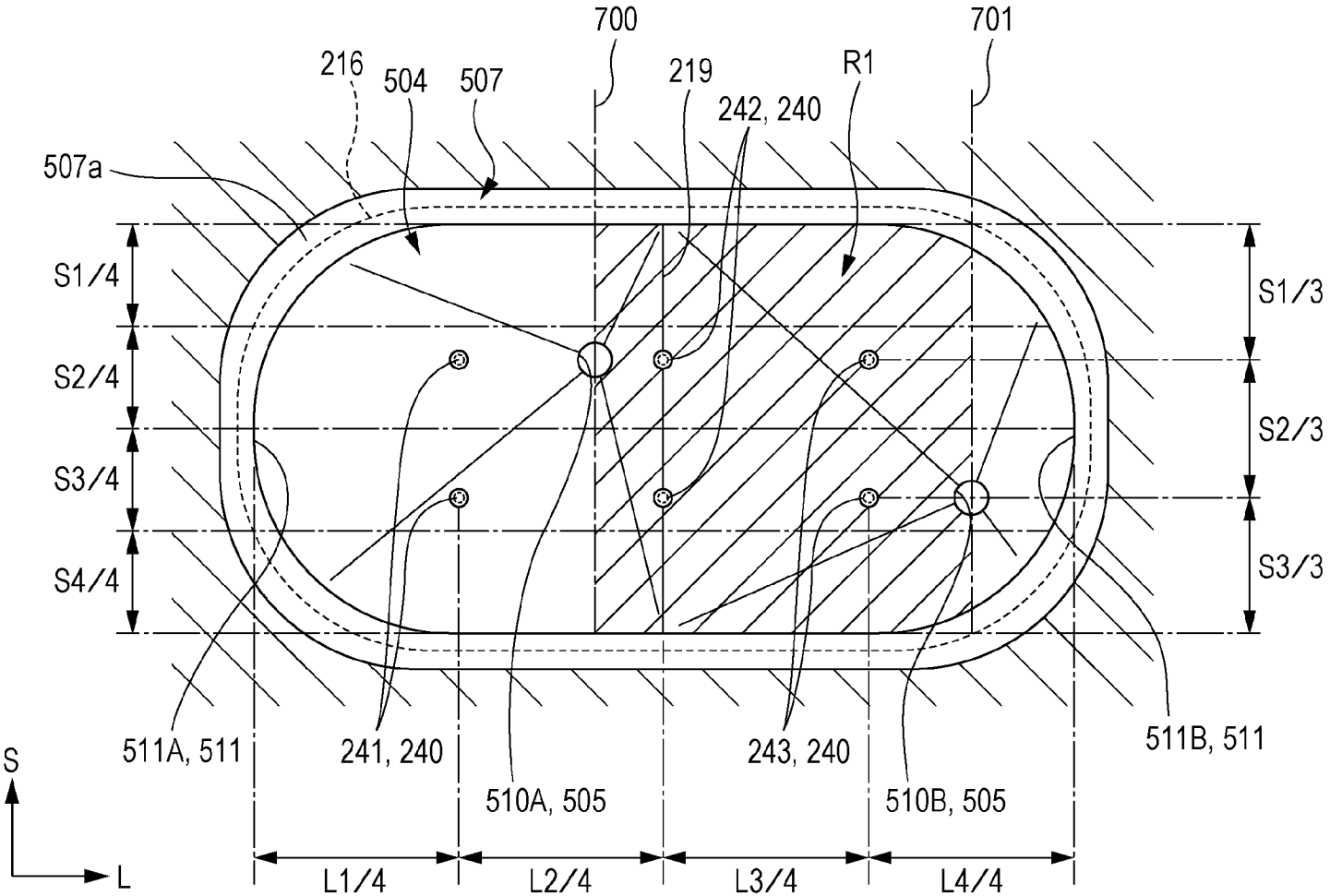
FIG. 17 is a planar diagram of a filter chamber in a modification example of the second embodiment.

In addition, in the same manner as the second modification example of the first embodiment described above, it is also possible to arrange the first opening section 510A and the second opening section 510B with a prescribed gap open in the short direction S. That is, in the modification example of the second embodiment shown in FIG. 17, the first opening section 510A is included at a boundary of S1/3 and S2/3 within the region in which the downstream filter chamber 504 is equally divided into three in the short direction S. In addition, the second opening section 510B is included at a boundary of S2/3 and S3/3 within a region in which the downstream filter chamber 504 is equally divided into three in the short direction S. Here, the position of the first opening section 510A and the second opening section 510B in the long direction L is the same as in the second embodiment described above. Then, also in the present modification example, it is possible to more effectively suppress sticking on the bottom surface 504*a* of the downstream filter chamber 504 due to changing of shape by deflection of the filter 216 by including the support 240 (the second support 242 and the third support 243) in the region R1 which is interposed between the opening center of the first opening section 510A and the opening center of the second opening section 510B in the long direction L. Here, since other configurations are the same as the second embodiment described above, explanation is omitted.

Furthermore, in the each embodiment described above the support 240 is formed in a point form, but the invention is not limited thereto. Although the effect of suppressing catching of bubbles, and the effect of suppressing a reduction in the effective area of the filter 216 are reduced, it is also possible to include the support wall 250 in which a support is formed in a straight line. For example, in the third embodiment shown in FIG. 18, the support wall 250 which is formed in a rectangular form in planar view is included. Here, the outer form of the upstream filter chamber 503, the downstream filter chamber 504, the filter attachment space 507, and the filter 216 of the present embodiment are formed in a rectangular form in planar view in the same manner as the first embodiment described above. In addition, the first opening section 510A and the second opening section 510B are open at the same position as the first embodiment described above.

The support wall 250 of the present embodiment is formed in a plate form which extends from the bottom surface 504*a* of the downstream filter chamber 504 toward the filter 216 side. The long direction in planar view of the support wall 250 is arranged along two diagonal lines 710 and 711 of the downstream filter chamber 504. In detail, a total of seven support walls 250 are included: five at equal intervals along the one diagonal line 710, and two at the corner section of the downstream filter chamber 504 along the other diagonal line 711. Here, in the present embodiment, five support walls 250 which are arranged on the one diagonal line 710 are referred to as a first support wall 251, a second support wall 252, a third support wall 253, a fourth support wall 254, and a fifth support wall 255 from a corner section at one side (the left side in FIG. 18) of the downstream filter chamber 504 toward the corner section at the other side (the right side in FIG. 18). In addition, the two support walls 250 which are arranged on the other diagonal line 711 are referred to as a sixth support wall 256 and a seventh support wall 257 from a corner section at one side of the downstream filter chamber 504 toward the corner section at the other side. Then, a welding portion 260 is formed in the leading end section of each support wall 250, and the leading end section of the support wall 250 is fused to the filter 216 using the welding portion 260. The welding portion 260 of the present embodiment is formed to be smaller than the support wall 250 in planar view in the state before melting. Here, the welding portion 260 before melting is represented by the broken line in FIG. 18.

In addition, in the present embodiment, the third support wall 253 and the fourth support wall 254 are arranged within the region R1 which is interposed between the opening center of the first opening section 510A and the opening center of the second opening section 510B in the long direction L. In addition, the first support wall 251, the second support wall 252, and the sixth support wall 256 are arranged in a region which is away at one side from the region R1, and the fifth support wall 255, and the seventh support wall 257 are arranged at the region away at the other side. Here, the first support wall 251, the fifth support wall 255, the sixth support wall 256, and the seventh support wall 257 are included contiguously from the inner wall surface of the downstream filter chamber 504 in the four corners of the downstream filter chamber 504. In addition, the plate thickness of each of the support wall sections 251, 252, 253, 254, 255, 256, and 257 are aligned the same.

In this manner, also in the present embodiment, it is possible to suppress the amount of deflection of the filter 216 to the bottom surface 504*a* side since a plurality of support walls 250 are included within the region R1. Thereby, it is possible to more effectively suppress sticking of the filter 216 to the bottom surface 504*a*. As a result, it is possible to suppress an increase in pressure loss due to catching of the filter 216 on the bottom surface 504*a* of the downstream filter chamber 504, and it is possible to suppress a meniscus of ink inside the nozzle 21 being destroyed. Additionally, since the support 240 is also included outside of the region R1, it is possible to more effectively suppress sticking on the bottom surface 504*a* due to deflection of the filter 216. Then, in the present embodiment, it is possible to increase the area which supports the filter 216 since the filter 216 is supported by the support walls 250 with a rectangular form in planar view. Thereby, it is possible to further suppress deflection of the filter 216 to the bottom surface 504*a* side. Here, since other configurations are the same as the first embodiment described above, explanation is omitted.

Figure 19:
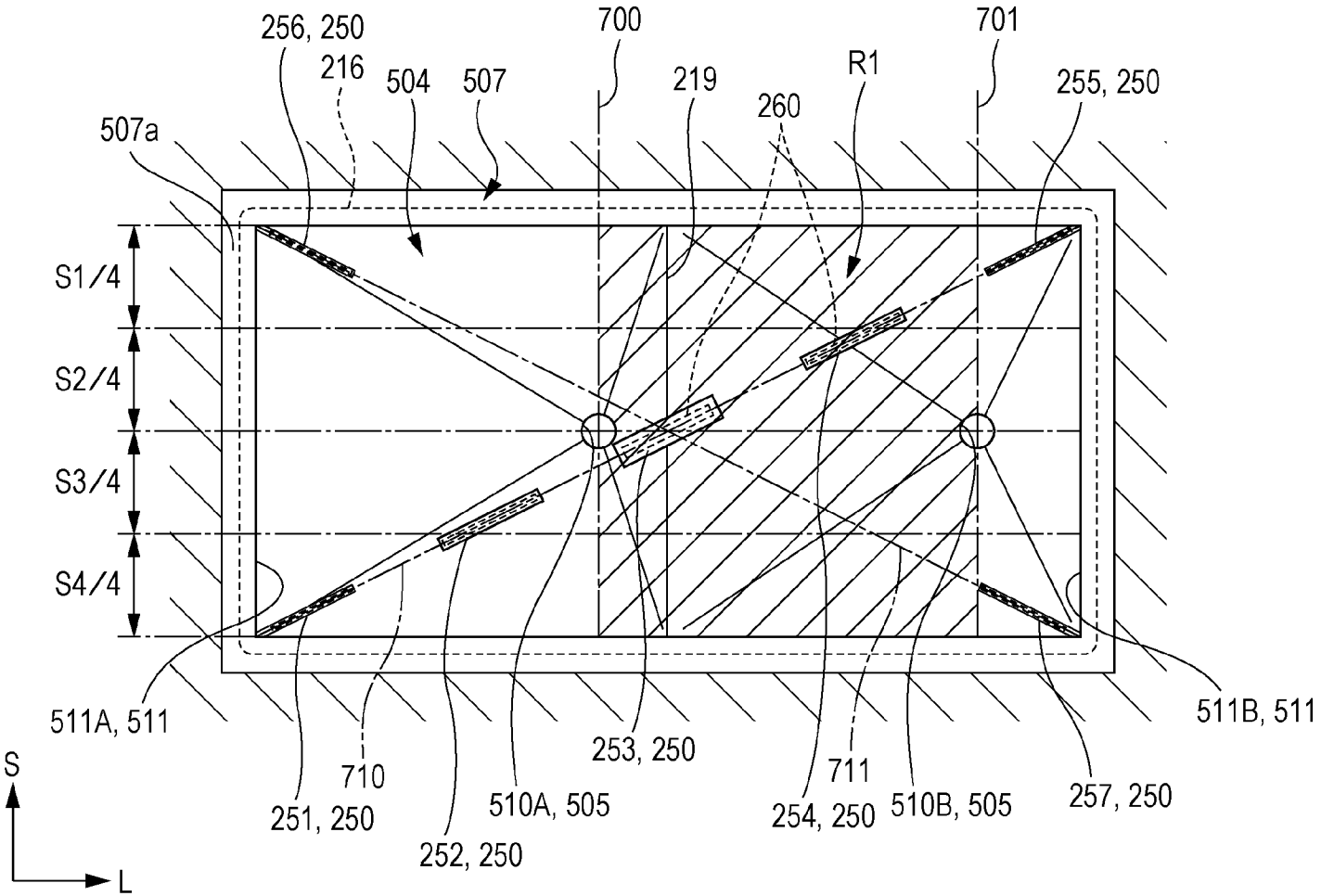
FIG. 19 is a planar diagram of a filter chamber in a modification example of the third embodiment.

Here, in the third embodiment described above, the plate thickness of each of the support wall sections 251, 252, 253, 254, 255, 256, and 257 are aligned the same, but are not limited thereto, and it is also possible to set different thicknesses. For example, in the modification example of the third embodiment shown in FIG. 19, the plate thickness of the support wall sections 250 are formed to be thicker the closer to the center of the filter 216, that is, the center in the long direction L. In detail, the plate thickness of the third support wall section 253 closest to the center of the filter 216 is the thickest, and the plate thicknesses of the first support wall 251, the fifth support wall 255, the sixth support wall 256, and the seventh support wall 257 furthest from the center of the filter 216 are the thinnest. In addition, the plate thicknesses of the second support wall section 252 which is positioned between the first support wall 251 and the third support wall section 253, and the fourth support wall section 254 which is positioned between the third support wall 253 and the fifth support wall section 255 are thicker than the plate thicknesses of the first support wall 251 and the fifth support wall section 255, and thinner than the plate thickness of the third support wall section 253.

Thereby, it is possible to support the center section of the filter 216 where deflection is relatively large more effectively on the third support wall 253. In addition, it is possible to suppress a reduction of the effective area of the filter 216 since a portion of the four corners of the filter 216 where deflection is relatively small is supported by the first support wall 251, the fifth support wall 255, the sixth support wall 256, and the seventh support wall 257 with thin thicknesses. Here, since other configurations are the same as the third embodiment described above, explanation is omitted.

Here, in the third embodiment and the modification example thereof, only the plate form support wall 250 is included, but the invention is not limited thereto. The support wall 250 and the point-form support 240 of the first embodiment described above may be mixed. In this case, it is desirable to arrange the support wall 250 with a large support area in the center section of the filter 216 where deflection is relatively large.

Figure 20:
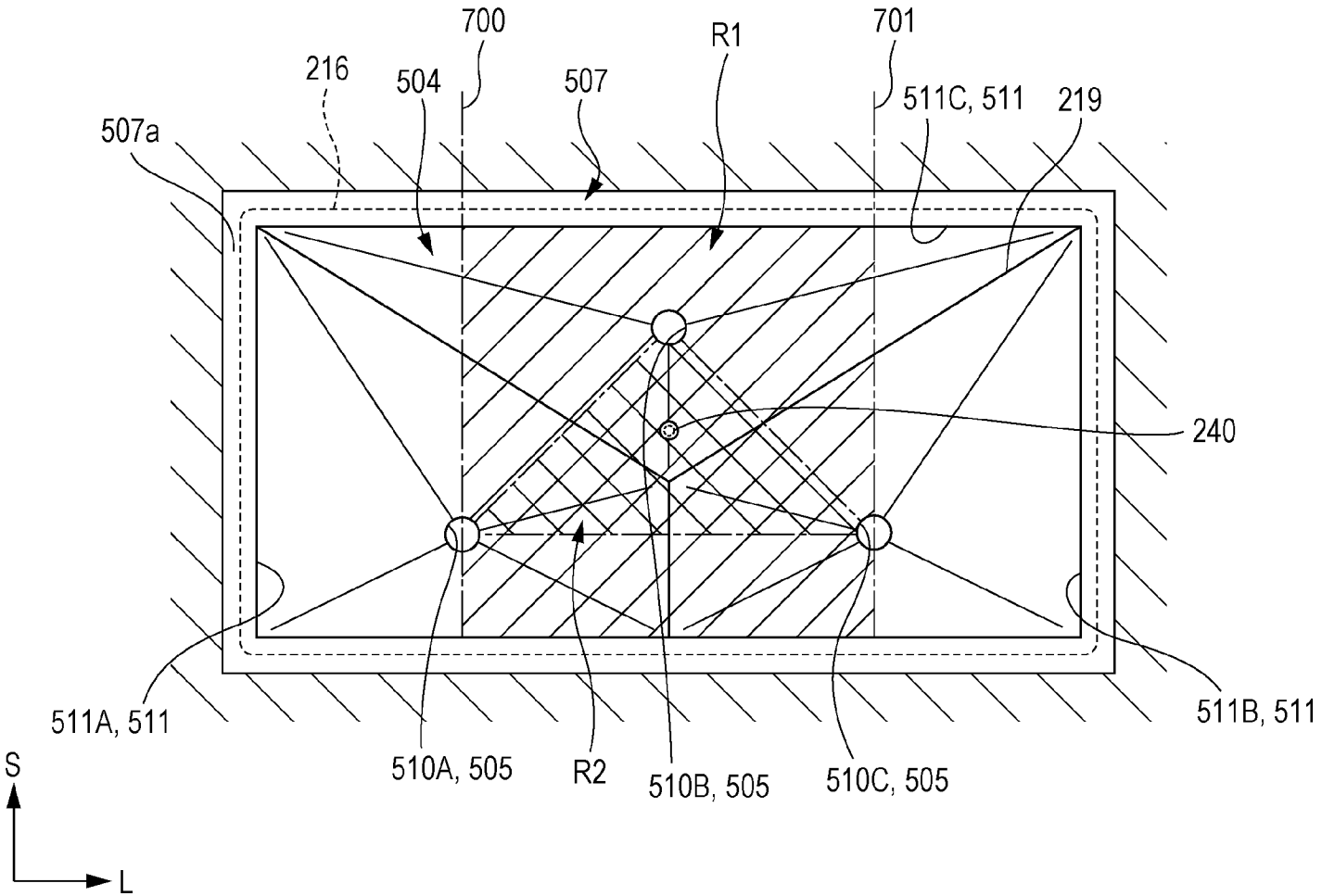
FIG. 20 is a planar diagram of a filter chamber of a fourth embodiment.

Here, as in the fourth embodiment shown in FIG. 20, in a case where the opening (the opening sections 510) of three third upstream flow paths 505 are included with respect to one downstream filter chamber 504 according, for example, to the configuration of the recording head 1, it is desirable to include the support 240 within the region R2 which is surrounded by the opening centers of the three opening sections 510.

When explaining in detail, the first opening section 510A, the second opening section 510B, and the third opening section 510C are included in order from one side (the left side in FIG. 20) in the long direction L toward the other side (the right side in FIG. 20) on the bottom surface 504*a* of the downstream filter chamber 504 of the fourth embodiment. The first opening section 510A and the third opening section 510C are aligned at the same position in the short direction S, and the second opening section 510B is arranged with a prescribed gap open to the first opening section 510A and the third opening section 510C in the short direction S. In addition, the ridge 219 is included respectively between the first opening section 510A and the second opening section 510B, between the second opening section 510B and the third opening section 510C, and between the first opening section 510A and the third opening section 510C. Thereby, the first recessed chamber 511A which the first opening section 510A opens, the second recessed chamber 511B which the second opening section 510B opens, and the third recessed chamber 511C which the third opening section 510C opens are partitioned. The three recessed chambers 511 are linked by a gap which is formed between the leading end of the ridge 219 and the filter 216 in the same manner as the first embodiment described above.

Then, the support 240 is included within the region R2 of a triangle shape which connects the opening center of the first opening section 510A, and the opening center of the second opening section 510B and the third opening section 510C in planar view. Here, the region R2 is included in the region R1 which is interposed between the opening center of the first opening section 510A and the opening center of the third opening section 510C in the long direction L. That is, the support 240 is included within the region R1. In this manner, also in the present embodiment, it is possible to suppress the amount of deflection of the filter 216 to the bottom surface 504*a* side since the support 240 is included within the region R1. In particular, in the present embodiment, it is possible to more effectively suppress the amount of deflection of the filter 216 to the bottom surface 504*a* side since the region R2 which is surrounded by the supports 240 at the opening centers of the three opening sections 510 is included. Thereby, it is possible to further effectively suppress sticking of the filter 216 to the bottom surface 504*a*. Here, since other configurations are the same as the first embodiment described above, explanation is omitted.

Here, in the fourth embodiment described above only one support 240 is included, but the invention is not limited thereto. A plurality of the supports 240 may be included inside the region R1 which includes the region R2 and outside the region R1. In addition, the openings (the opening sections 510) of three third upstream flow paths 505 are included with respect to the downstream filter chamber 504, but the invention is not limited thereto. Three or more opening sections 510 may be included with respect to the downstream filter chamber 504. Furthermore, it is possible to set the positions of the opening sections 510 appropriately according to the configuration (position) of the flow path at the downstream side.

Here, in each embodiment described above, in planar view, the filter chamber 520 and the filter 216 with a form which has the long direction L and the short direction S are exemplified, but the invention is not limited thereto. It is possible to apply the form without the long direction L and the short direction S to the invention, for example, in planar view, a rectangular form or a circular form. In addition, the second upstream flow path 502 described above is open substantially to the center of the upstream filter chamber 503, but the invention is not limited thereto. It is possible to appropriately set the opening position of the second upstream flow path 502 according to the configuration (position) of the flow path further to the upstream side than the second upstream flow path 502.

In addition, in the printer I described above, the recording head 1 is exemplified as being mounted on the carriage 3 and moving in the scanning direction, but the invention is not limited thereto. It is also possible to apply the invention, for example, to a so-called line-type printer in which the recording head 1 is fixed, and which performs printing by moving the recording medium S such as recording paper in the sub-scanning direction. Furthermore, in the recording head 1 described above, two head main bodies 2 (the first head main body 2A and the second head main body 2B) are exemplified as being included, but the invention is not limited thereto. It is also possible to apply the invention to a recording head which includes one head main body 2, a recording head which includes three or more head main bodies 2, or the like.

Then, the printer I which includes the recording head 1 that is one type of ink jet head is described by being given as an example of an ink jet printer, but the invention is not limited thereto, and it is also possible to apply the invention to another ink jet printer in which a flow path member is mounted which includes a flow path and a filter. For example, it is also possible to apply the invention to a color ejecting head which is mounted in a printer for manufacturing a display (a liquid ejecting apparatus for manufacturing a display) which manufactures a color filter such as a liquid crystal display, an electrode ejecting head which is mounted in a printer for manufacturing electrodes (a liquid ejecting apparatus for manufacturing electrodes) which forms an electrode such as an organic EL (Electro Luminescence) display, an FED (Field Emission Display) or the like, and the like. In addition, it is also possible to apply the invention to an apparatus or the like other than an ink jet printer which includes a flow path member including a flow path and a filter.

The entire disclosure of Japanese Patent Application No. 2014-176909, filed Sep. 1, 2014 is expressly incorporated by reference herein.

What is claimed is:

1. A flow path member comprising:

a first space which is opened by a first liquid flow path, and into which liquid flows from the first liquid flow path;

a second space which is opened by a second liquid flow path on a bottom surface at the opposite side to the first space, and out of which liquid flows from the second liquid flow path;

a filter which filters liquid passing therethrough, and which is included between the first space and the second space; and a support which protrudes from the bottom surface of the second space toward the filter side, wherein the second space includes a plurality of second liquid flow paths, and the support projection is included within a region which is interposed between the opening centers of at least two second liquid flow paths in the long direction of the filter.

2. The flow path member according to claim 1, wherein an opening position of the second space of the second liquid flow path is eccentric in the in-plane direction of a surface parallel to the filter with respect to an opening position of the first space of the first liquid flow path.

3. An ink jet head comprising the flow path member according to claim 2.

4. The flow path member according to claim 1, wherein a leading end section of the support is fixed to the filter.

5. The flow path member according to claim 4, further comprising:

a welding portion that has thermoplasticity in the leading end section of the support, wherein the leading end section of the support is fixed to the filter by fusing of the welding portion.

6. An ink jet head comprising the flow path member according to claim 5.

7. An ink jet head comprising the flow path member according to claim 4.

8. The flow path member according to claim 1, wherein the second space includes at least three second liquid flow paths, and the support is included within a region which is surrounded by the opening centers of at least the plurality of second liquid flow paths.

9. An ink jet head comprising the flow path member according to claim 8.

10. The flow path member according to claim 1, wherein a recessed chamber where the diameter reduces from the filter side of each second liquid flow path toward the opening of the second liquid flow path is formed on the bottom surface of the second space, and each recessed chamber is partitioned by a ridge which is raised from the bottom surface toward the filter side between the openings of adjacent second liquid flow paths, and is linked by a gap between the ridge and the filter.

11. An ink jet head comprising the flow path member according to claim 10.

12. The flow path member according to claim 1, wherein a plurality of the supports are included within the region.

13. An ink jet head comprising the flow path member according to claim 12.

14. The flow path member according to claim 1, wherein the filter is fixed to an opening edge of the second space, the support is included outside of the region in the second space, and at least the support which is included outside of the region protrudes further to the first space side than the surface of the second space side of the filter in the region in which the filter is fixed.

15. An ink jet head comprising the flow path member according to claim 14.

16. An ink jet head comprising the flow path member according to claim 1.

17. An ink jet printer comprising the ink jet head according to claim 16.

* * * * *